US011104153B2

(12) United States Patent
Shinoda et al.

(10) Patent No.: US 11,104,153 B2
(45) Date of Patent: Aug. 31, 2021

(54) THERMAL-TRANSFER PRINTER WITH A MOVABLE MEMBER MOVABLE TO EXPOSE AN INK RIBBON SUPPORTING MEMBER

(71) Applicant: Brother Kogyo Kabushiki Kaisha, Nagoya (JP)

(72) Inventors: Mayu Shinoda, Nagoya (JP); Yasuyuki Narumiya, Nagakute (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 303 days.

(21) Appl. No.: 16/163,679

(22) Filed: Oct. 18, 2018

(65) Prior Publication Data

US 2019/0118552 A1 Apr. 25, 2019

(30) Foreign Application Priority Data

Oct. 20, 2017 (JP) ..... JP2017-203893

(51) Int. Cl.

| | |
|---|---|
| ***B41J 2/325*** | (2006.01) |
| ***B41J 33/00*** | (2006.01) |
| ***B41J 17/32*** | (2006.01) |
| ***B41J 15/04*** | (2006.01) |

(52) U.S. Cl.

CPC ..... *B41J 2/325* (2013.01); *B41J 15/042* (2013.01); *B41J 17/32* (2013.01); *B41J 33/003* (2013.01)

(58) Field of Classification Search

CPC ..... B41J 2/325

See application file for complete search history.

(56) References Cited

U.S. PATENT DOCUMENTS 5,385,416 A * 1/1995 Maekawa ..... B41J 17/36 400/208
5,447,382 A * 9/1995 Yui ..... B41J 17/32 400/120.02

(Continued)

FOREIGN PATENT DOCUMENTS

EP 0982140 A2 * 3/2000 ..... B41J 33/16
JP 2000-272200 A 10/2000

(Continued)

OTHER PUBLICATIONS

Jan. 26, 2021—(JP) Notification for Reasons for Refusal—App 2017-203893.

*Primary Examiner* — Jill E Culler
(74) *Attorney, Agent, or Firm* — Banner & Witcoff, Ltd.

(57) ABSTRACT

A thermal-transfer printer including a movable member and a head holder, is provided. A first axis of the movable member is located to be closer to a second side of the thermal-transfer printer in an orthogonal direction than a first center being a position of a center of a first spool, and higher than a lower-end position, which is lower than the first center and a second center being a position of a center of the second spool, and is apart from the first center and the second center for a half distance being a predetermined distance divided equally by two. A second axis being a pivot axis of the head holder is located to be closer to the first side in the orthogonal direction than the first center, closer to the second side in the orthogonal direction than the second center, and higher than the lower-end position.

12 Claims, 25 Drawing Sheets

(56) References Cited

U.S. PATENT DOCUMENTS

| | | | | |
|---|---|---|---|---|
| 6,236,420 | B1 * | 5/2001 | Matsuzaka | B41J 2/32 347/170 |
| 6,361,231 | B1 | 3/2002 | Sato et al. | |
| 6,390,697 | B1 * | 5/2002 | O'Mera | B41J 2/325 347/197 |
| 6,457,885 | B1 * | 10/2002 | Yamamoto | B41J 35/28 400/207 |
| 7,014,376 | B2 * | 3/2006 | Maruyama | B41J 2/325 400/120.01 |
| 7,081,911 | B2 * | 7/2006 | Sawai | B41J 2/325 347/197 |
| 9,211,744 | B2 | 12/2015 | Wong et al. | |
| 2015/0165797 | A1 | 6/2015 | Chari et al. | |
| 2015/0165802 | A1 | 6/2015 | Wong et al. | |

FOREIGN PATENT DOCUMENTS

| | | | | |
|---|---|---|---|---|
| JP | 2002-127531 | A | 5/2002 | |
| JP | 2002-225386 | A | 8/2002 | |
| JP | 2013199031 | A * | 10/2013 | G06K 15/02 |
| JP | 2017-503684 | A | 2/2017 | |

* cited by examiner

THERMAL-TRANSFER PRINTER WITH A MOVABLE MEMBER MOVABLE TO EXPOSE AN INK RIBBON SUPPORTING MEMBER

CROSS REFERENCE TO RELATED APPLICATION

This application claims priority from Japanese Patent Application No. 2017-203893, filed on Oct. 20, 2017, the entire subject matter of which is incorporated herein by reference.

BACKGROUND

Technical Field

An aspect of the present disclosure is related to a thermal-transfer printer.

Related Art

A media processing device having a base, a lid, and a ribbon positioning assembly, is known. The lid may be pivotable with respect to the base to open or close an opening in the base. To the lid, a holder holding a printing head may be attached to move along with the lid. To the ribbon positioning assembly, a ribbon cartridge may be attachable. In the ribbon cartridge, two (2) spools, around which an ink ribbon is rolled, may be stored. The ink ribbon may be held extended between the two spools inside the ribbon cartridge. The ribbon positioning assembly may be maintained at a position in proximity to the lid and may pivot to move with respect to the base along with the opening or closing motion of the lid. The printing head may be maintained steady at a position in proximity with respect to ribbon extended between the spools regardless of a pivotable position of the lid or the ribbon positioning assembly.

The ribbon cartridge may be detached from or attached to the ribbon positioning assembly when the lid is at an open position. As the lid moves from the open position to a closed position, the printing head may contact the ink ribbon extended between the spools. When the lid is at the closed position, a printing medium and the ink ribbon may be placed between the printing head and a platen roller held by the base. With the printing medium and the ink ribbon placed between the printing head and the platen roller, the printing head may be heated so that the ink on the ink ribbon may be transferred onto the medium to print an image on the medium.

SUMMARY

The ribbon positioning assembly in the above-mentioned media processing device may stay at the position with respect to the lid and may pivotably move with respect to the base along with the opening or closing motion of the lid. Meanwhile, a ribbon positioning assembly, which is configured to stay at a position with respect to a base while a lid may move from a closed position to an open position, may be suggested. In this configuration, when a head holder moves downward to pass through a position between two spools along with a downward motion of the lid, the head holder may undesirably contact the spools. In order to avoid the head holder from contacting the spools, a movable path for the head holder may be enlarged so that the head holder may move through a position substantially separated from the spools. However, the enlarged movable path for the head holder may increase a size of the media processing device.

The present disclosure is advantageous in that a size-reducible thermal-transfer printer is provided.

According to an aspect of the present disclosure, a thermal-transfer printer configured to print an image on a printing medium by heating an ink ribbon through a thermal head, is provided. The thermal-transfer printer includes a medium storage configured to store the printing medium therein; an ink ribbon supporting member, to which the ink ribbon connected to a first spool at one end and to a second spool at the other end is attachable, the ink ribbon supporting member being located to be at least partly higher than the medium storage; a movable member configured to be pivotable about a first axis to move between a first position and a second position being higher than the first position, the first axis extending in a predetermined direction, the movable member being located to be at least partly higher than the ink ribbon supporting member; and a head holder pivotably attached to the movable member to pivot about a second axis extending in the predetermined direction, the head holder being configured to support the thermal head. In the ink ribbon supporting member, a center of the first spool and a center of the second spool extend in parallel with the predetermined direction; the center of the first spool and the center of the second spool are apart from each other for a predetermined distance in an orthogonal direction, the orthogonal direction being orthogonal to the predetermined direction; and the ink ribbon is attachable with the second spool being arranged at a position closer to a first side of the thermal-transfer printer than the first spool in the orthogonal direction. One of the thermal head and the head holder is configured to contact the ink ribbon extended between the first spool and the second spool in response to the movable member moving from the second position toward the first position. The first axis under a condition where the movable member is at the first position is located in an area, which is closer to a second side of the thermal-transfer printer in the orthogonal direction than a first center being a position of the center of the first spool, the second side being opposite to the first side in the orthogonal direction; and higher than a lower-end position, the lower-end position being lower than the first center and a second center being a position of the center of the second spool, the lower-end position being apart from the first center and the second center for a half distance being the predetermined distance divided equally by two. The second axis under the condition where the movable member is at the first position is located in an area, which is closer to the first side in the orthogonal direction than the first center, closer to the second side in the orthogonal direction than the second center, and higher than the lower-end position.

BRIEF DESCRIPTION OF THE ACCOMPANYING DRAWINGS

Figure 5:
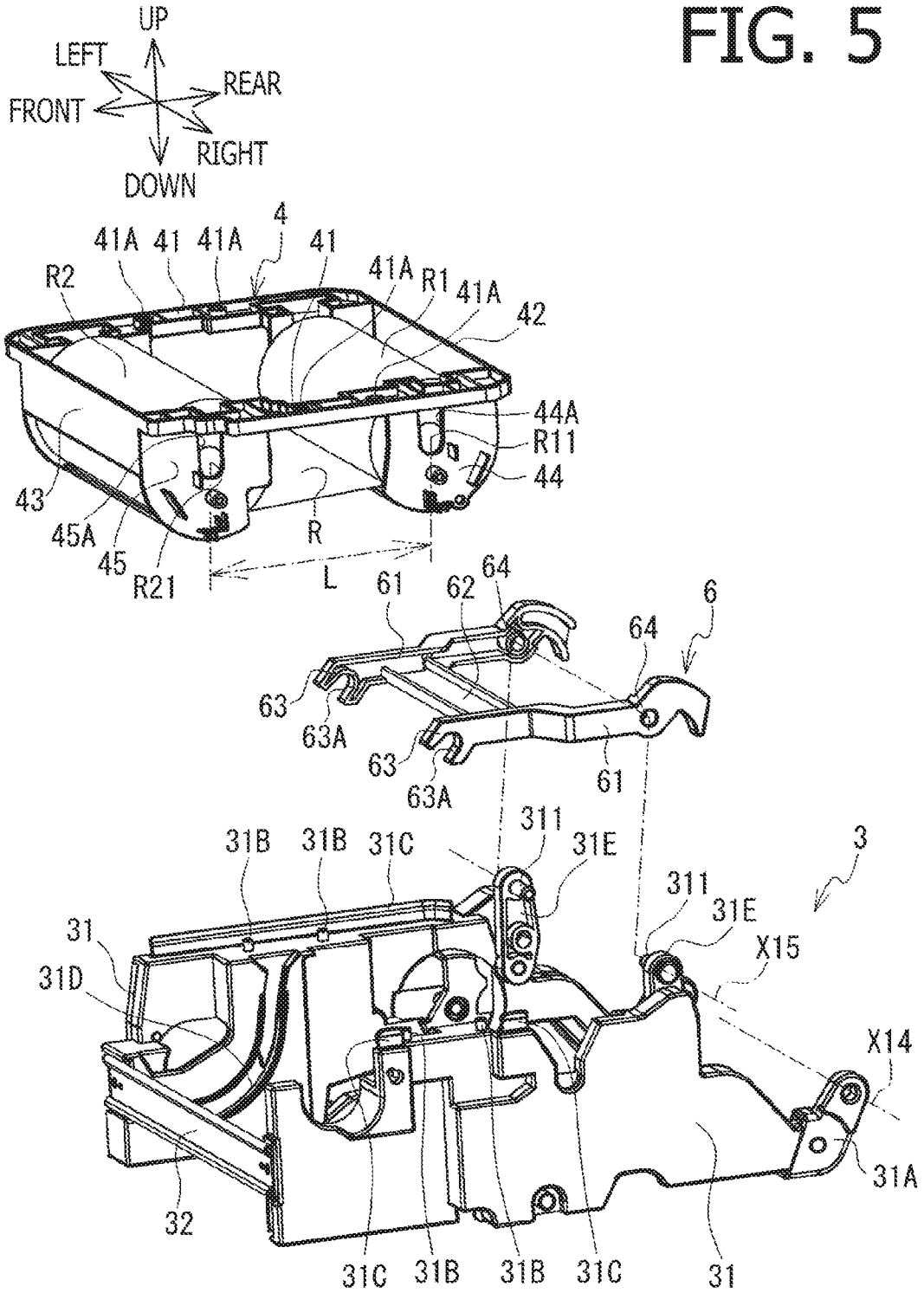

FIG. 5 is an exploded perspective view of an ink ribbon supporting member 3, a cartridge case 4, and a subsidiary arm 6 in the thermal-transfer printer 1A according to the embodiment of the present disclosure.

Figure 6:
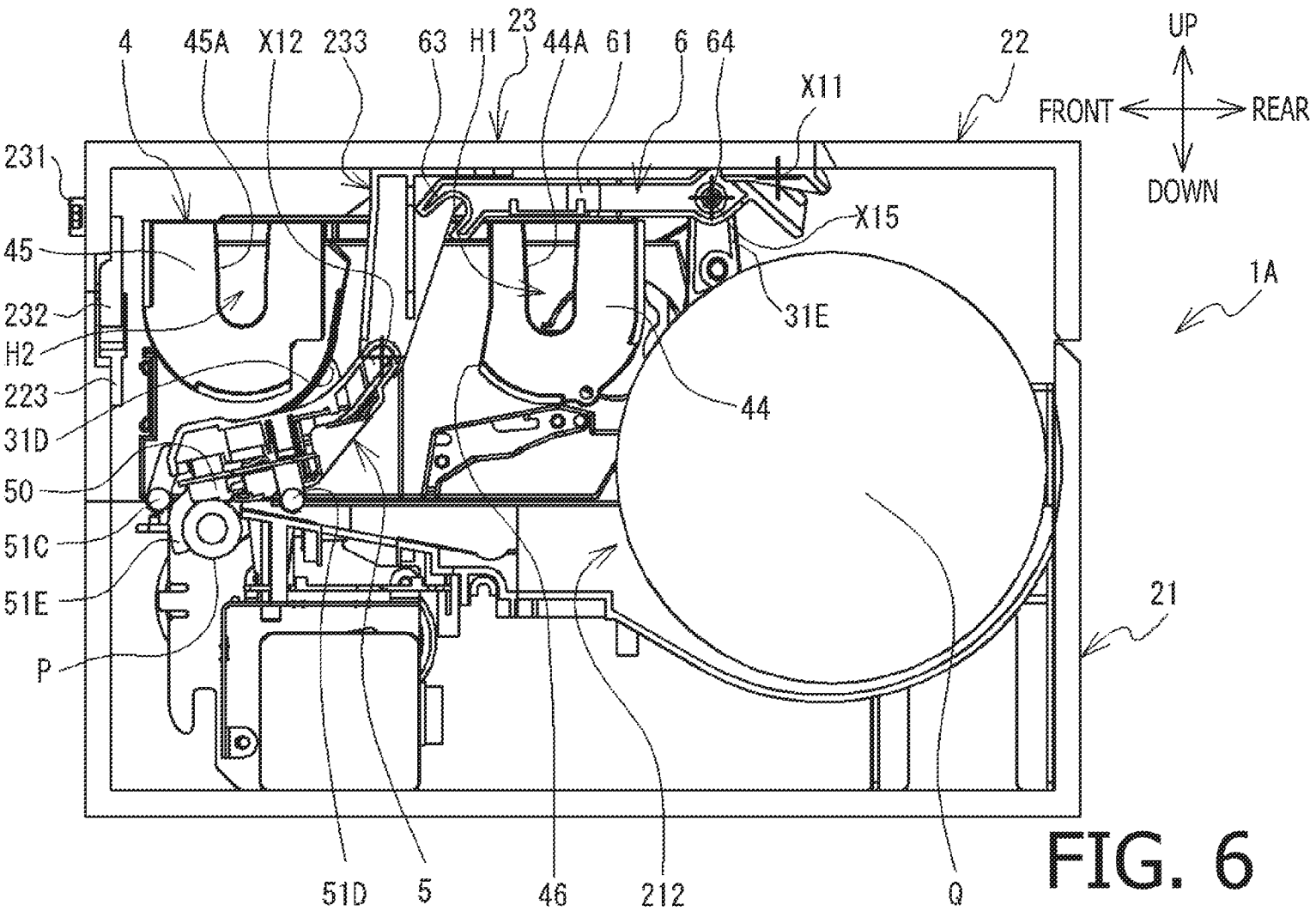

FIG. 6 is a cross-sectional view of the thermal-transfer printer 1A according to the first embodiment of the present disclosure with the cover 23 at the first position (closed position).

Figure 7:
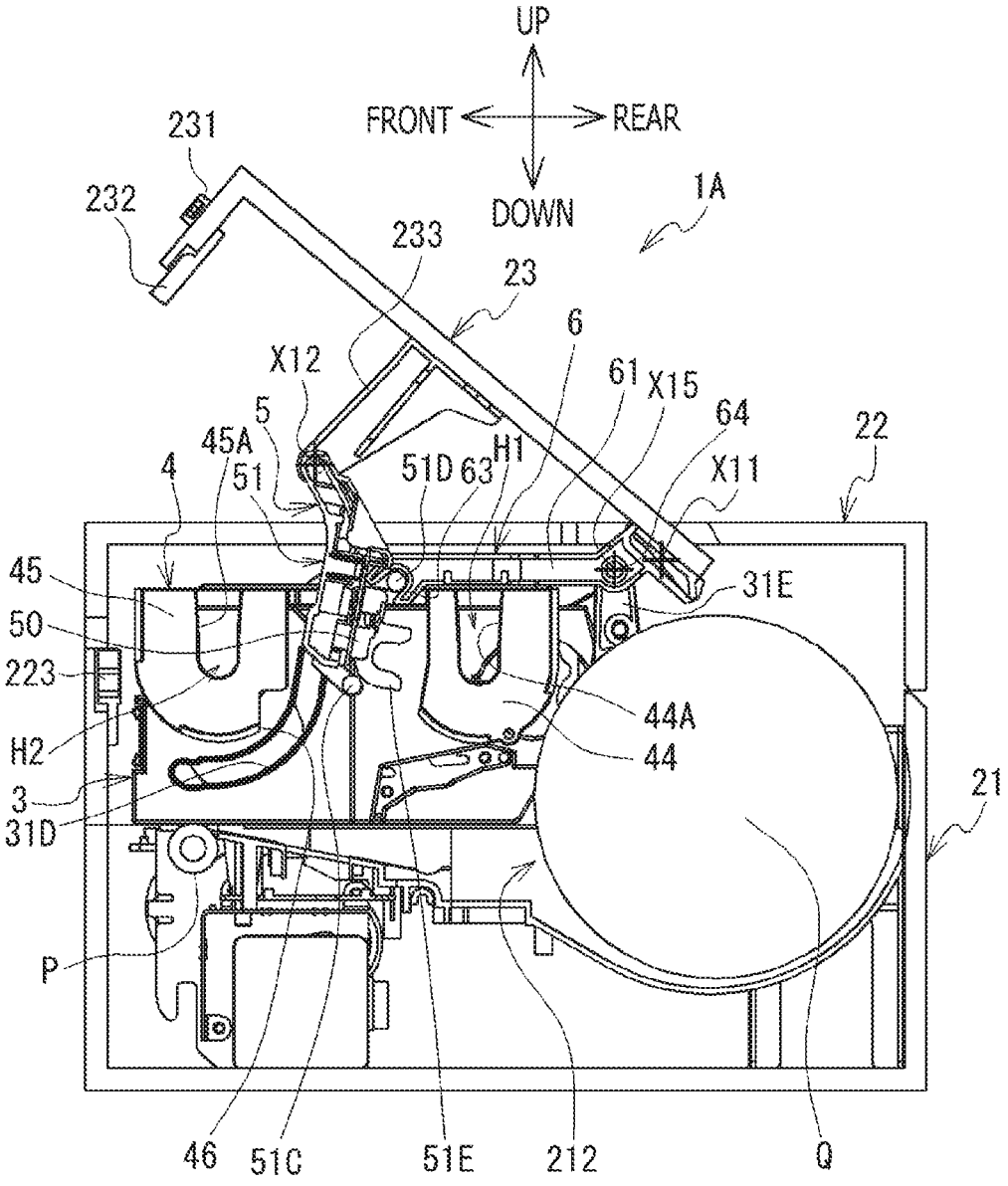

FIG. 7 is a cross-sectional view of the thermal-transfer printer 1A according to the first embodiment of the present disclosure with the cover 23 at an interim position between the first position (closed position) and the second position (open position).

Figure 8:
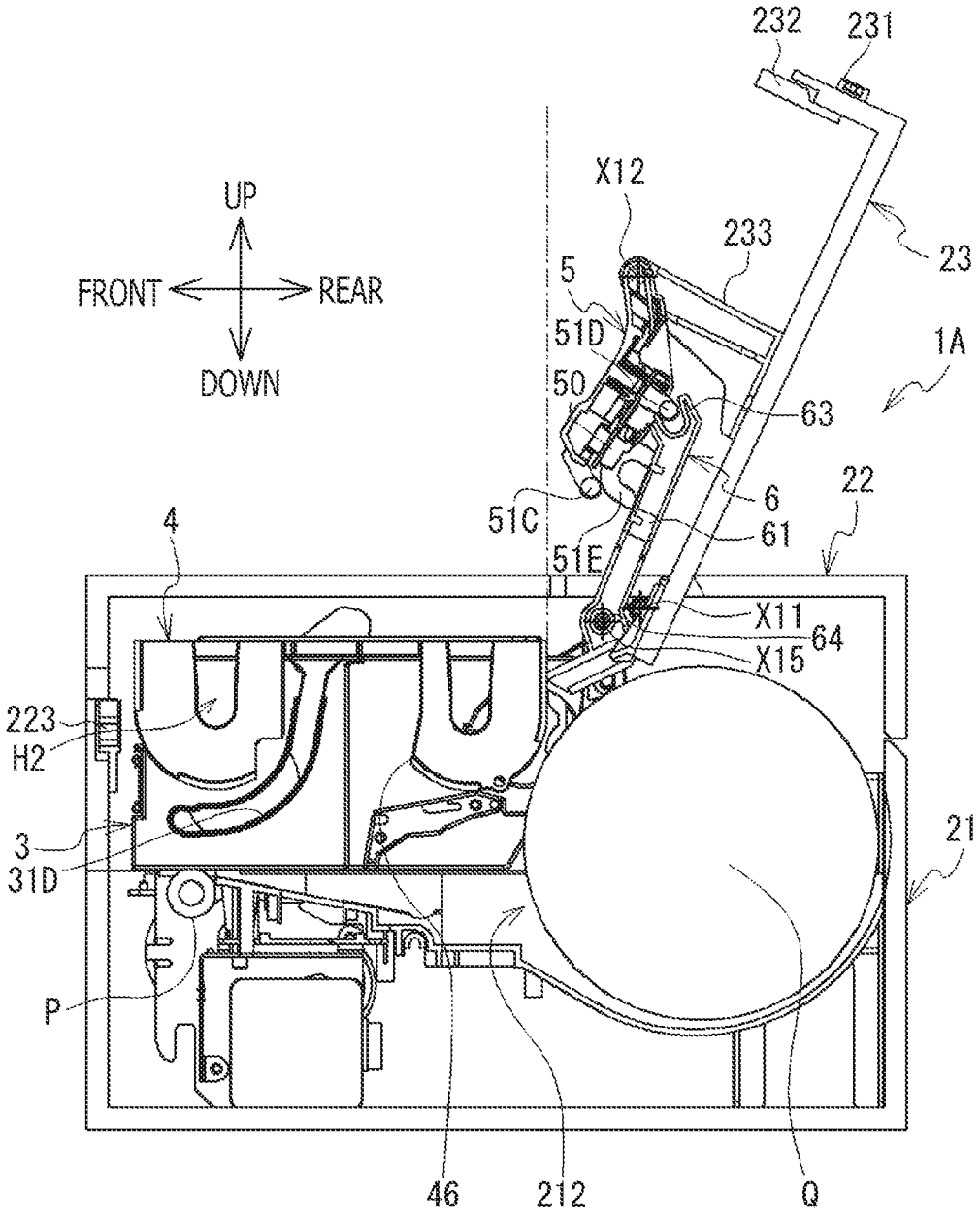

FIG. 8 is a cross-sectional view of the thermal-transfer printer 1A according to the first embodiment of the present disclosure with the cover 23 at the second position (open position).

Figure 9:
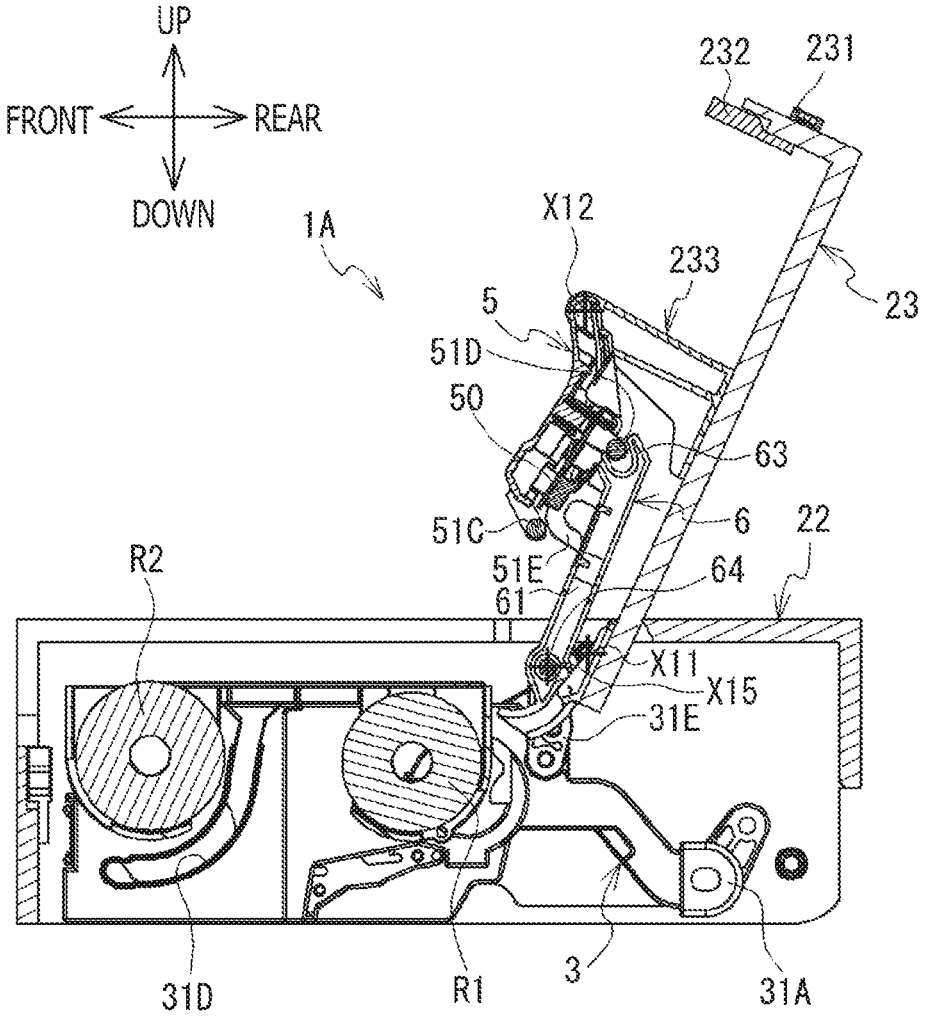

FIG. 9 is a cross-sectional partial view the thermal-transfer printer 1A according to the first embodiment of the present disclosure with the cover 23 at the second position (open position).

Figure 10:
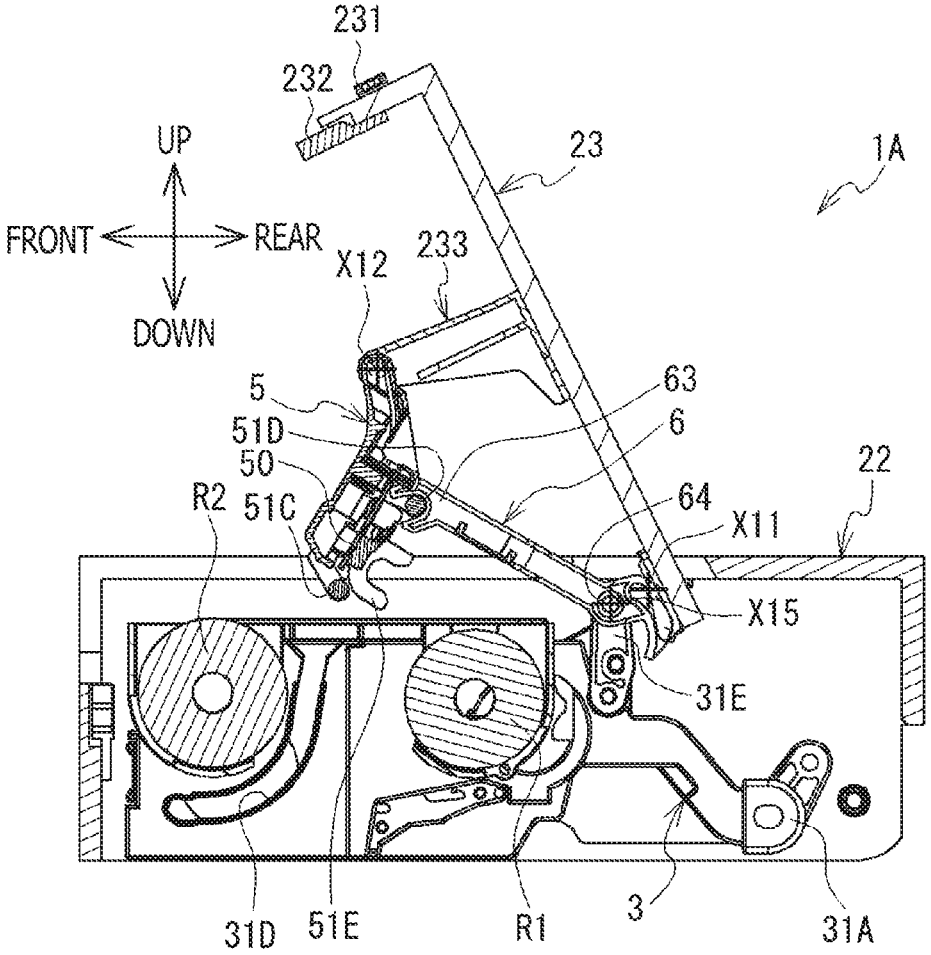

FIG. 10 is a cross-sectional partial view of the thermal-transfer printer 1A according to the first embodiment of the present disclosure with the cover 23 at an interim position between the second position (open position) and the first position (closed position).

Figure 11:
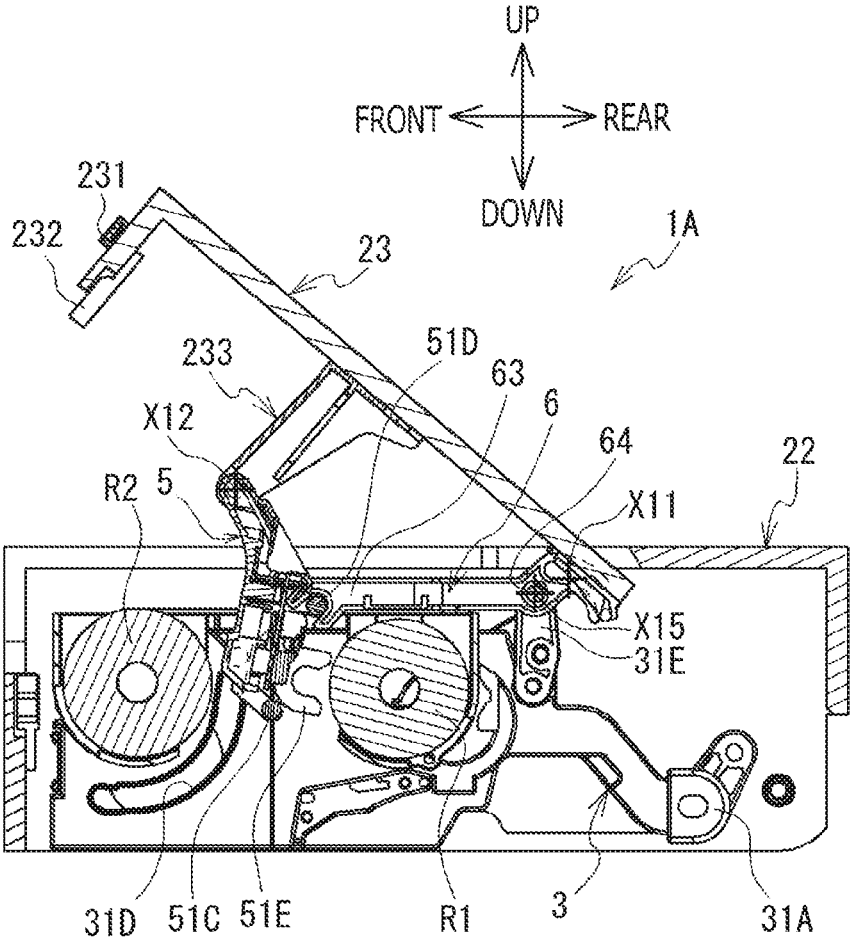

FIG. 11 is a cross-sectional partial view of the thermal-transfer printer 1A according to the first embodiment of the present disclosure with the cover 23 moved further toward the first position (closed position).

Figure 12:
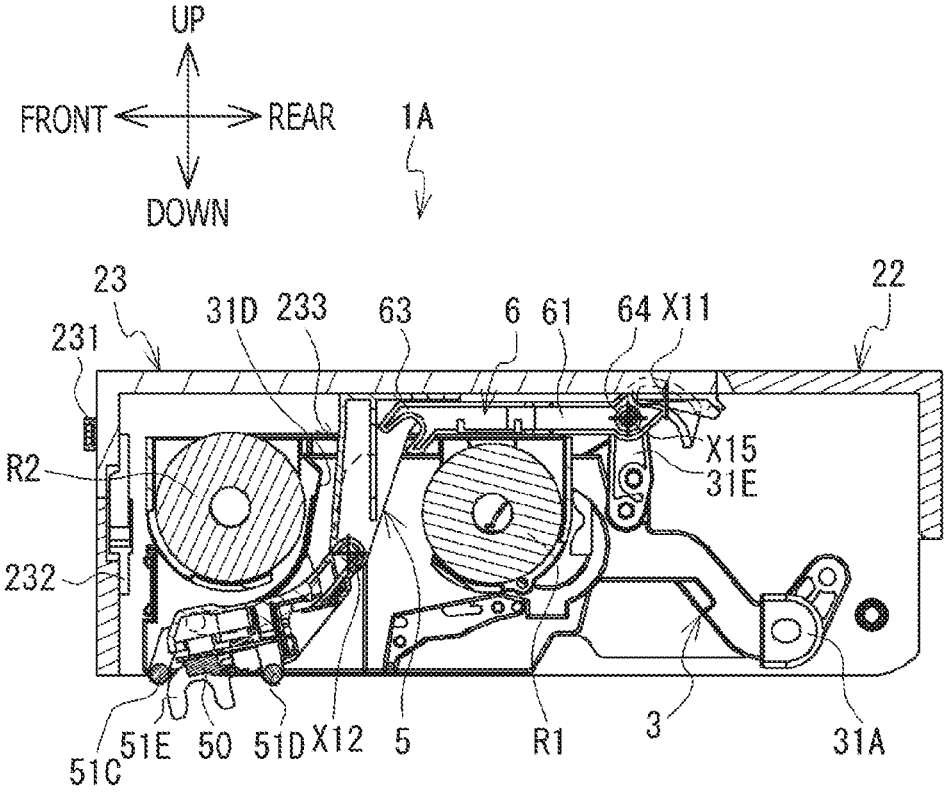

FIG. 12 is a cross-sectional partial view the thermal-transfer printer 1A according to the first embodiment of the present disclosure with the cover 23 at the first position (closed position).

Figure 13:
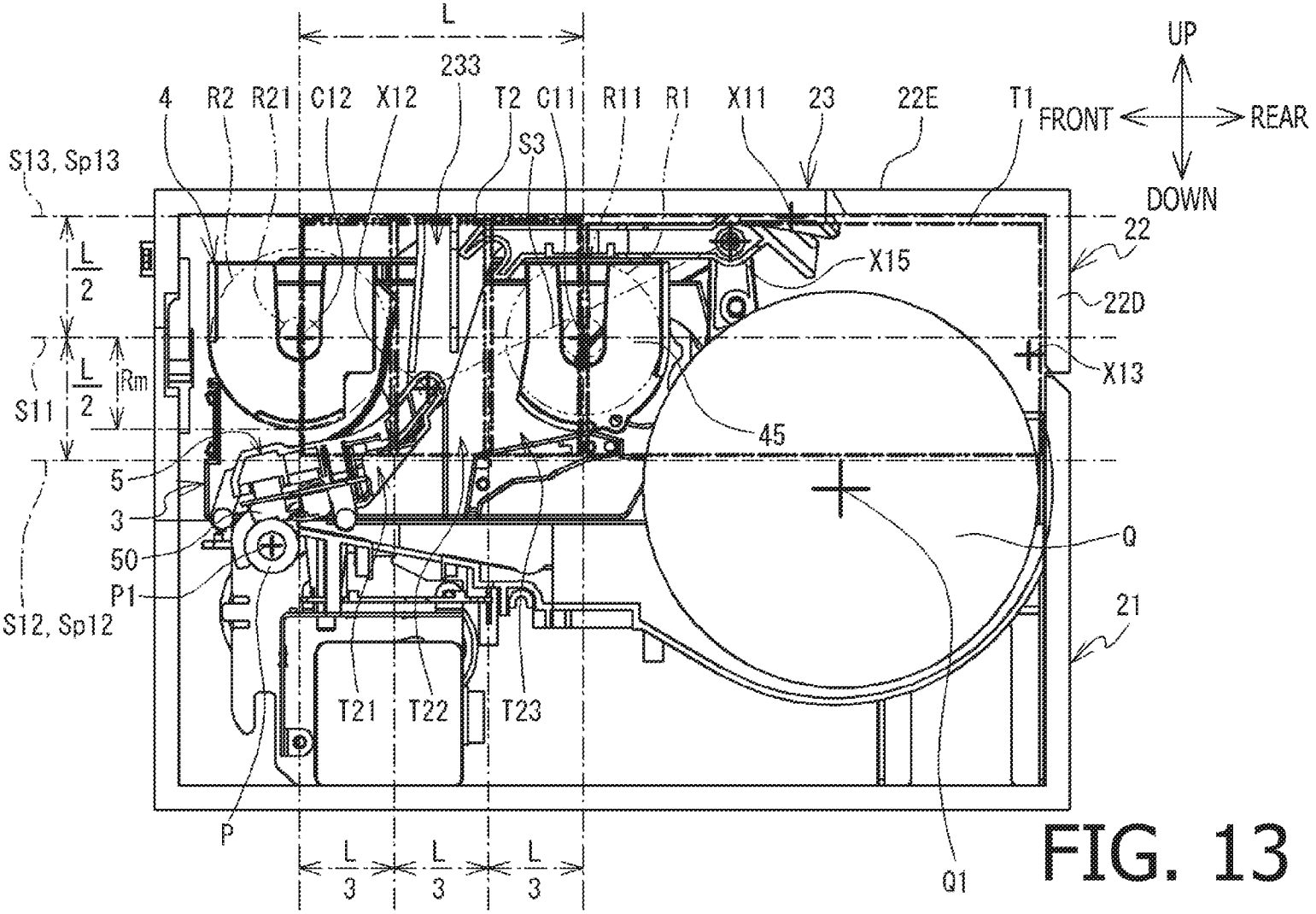

FIG. 13 is a cross-sectional view of the thermal-transfer printer 1A to illustrate relative positions of a first axis X11 and a second axis X12 according to the first embodiment of the present disclosure.

Figure 14:
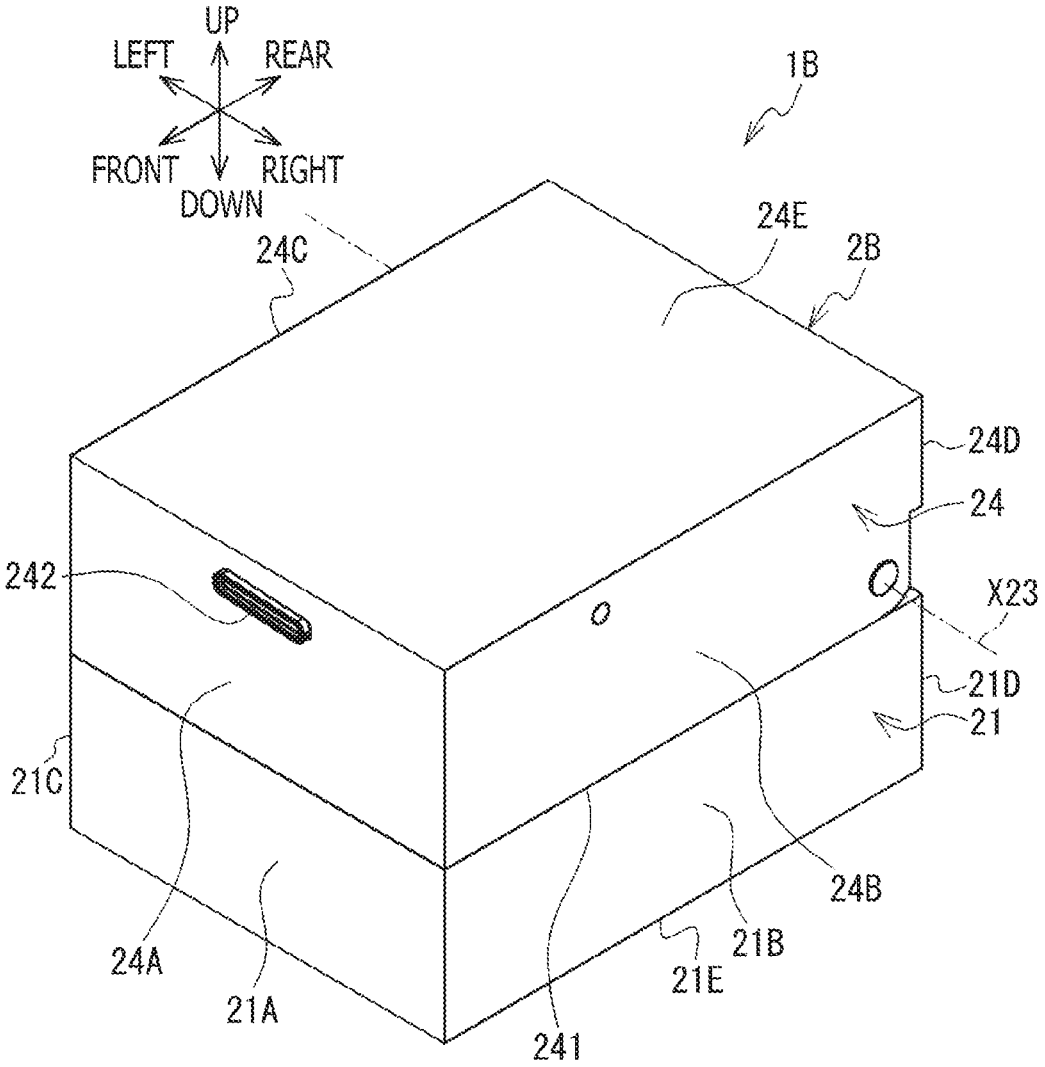

FIG. 14 is a perspective view of a thermal-transfer printer 1B according to a second embodiment of the present disclosure with a second case 24 at a third position (closed position).

Figure 15:
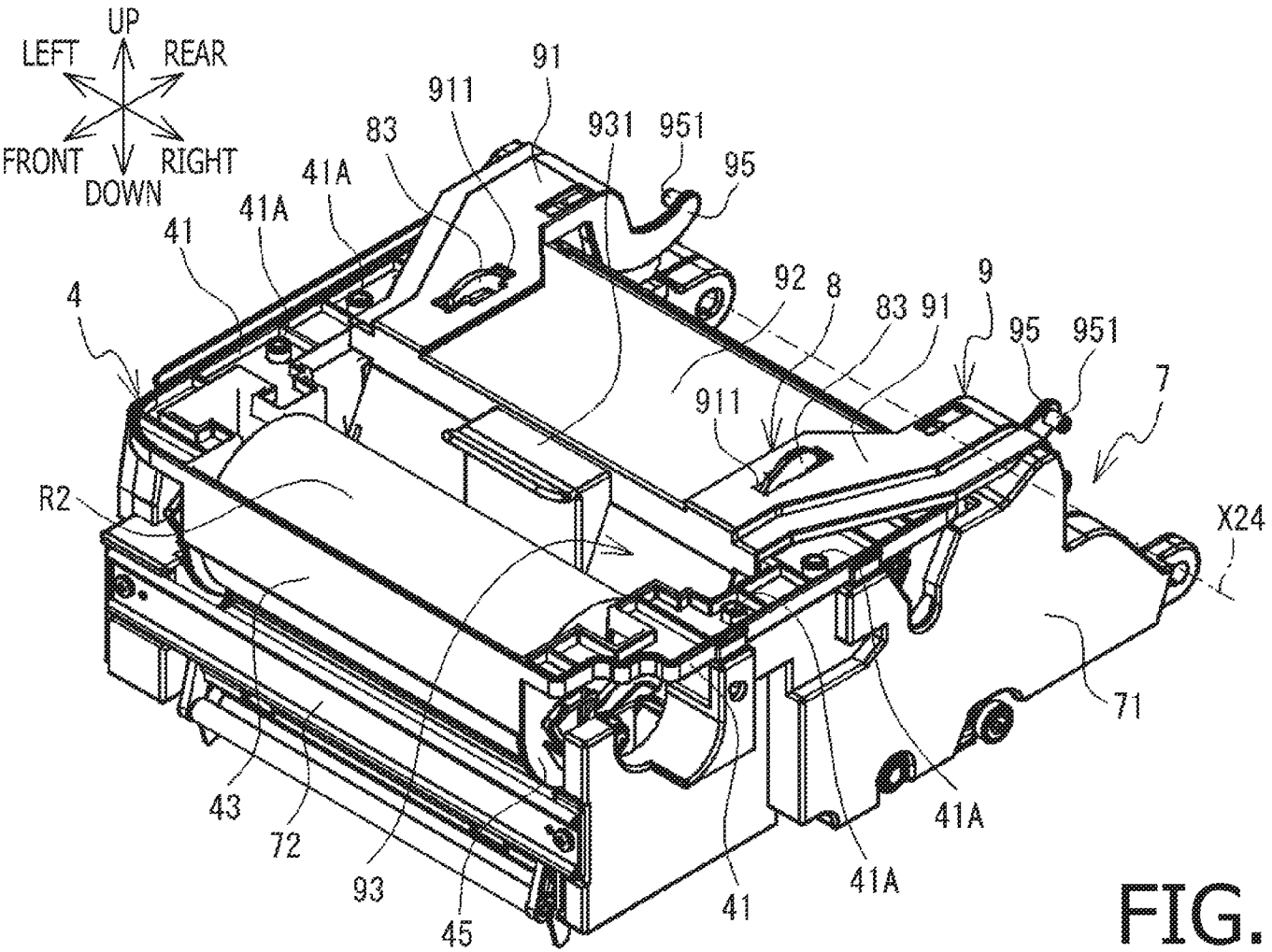

FIG. 15 is a perspective view of an ink ribbon supporting member 7 in a condition to be stored in the second case 24 in the thermal-transfer printer 1B according to the second embodiment of the present disclosure.

Figure 16:
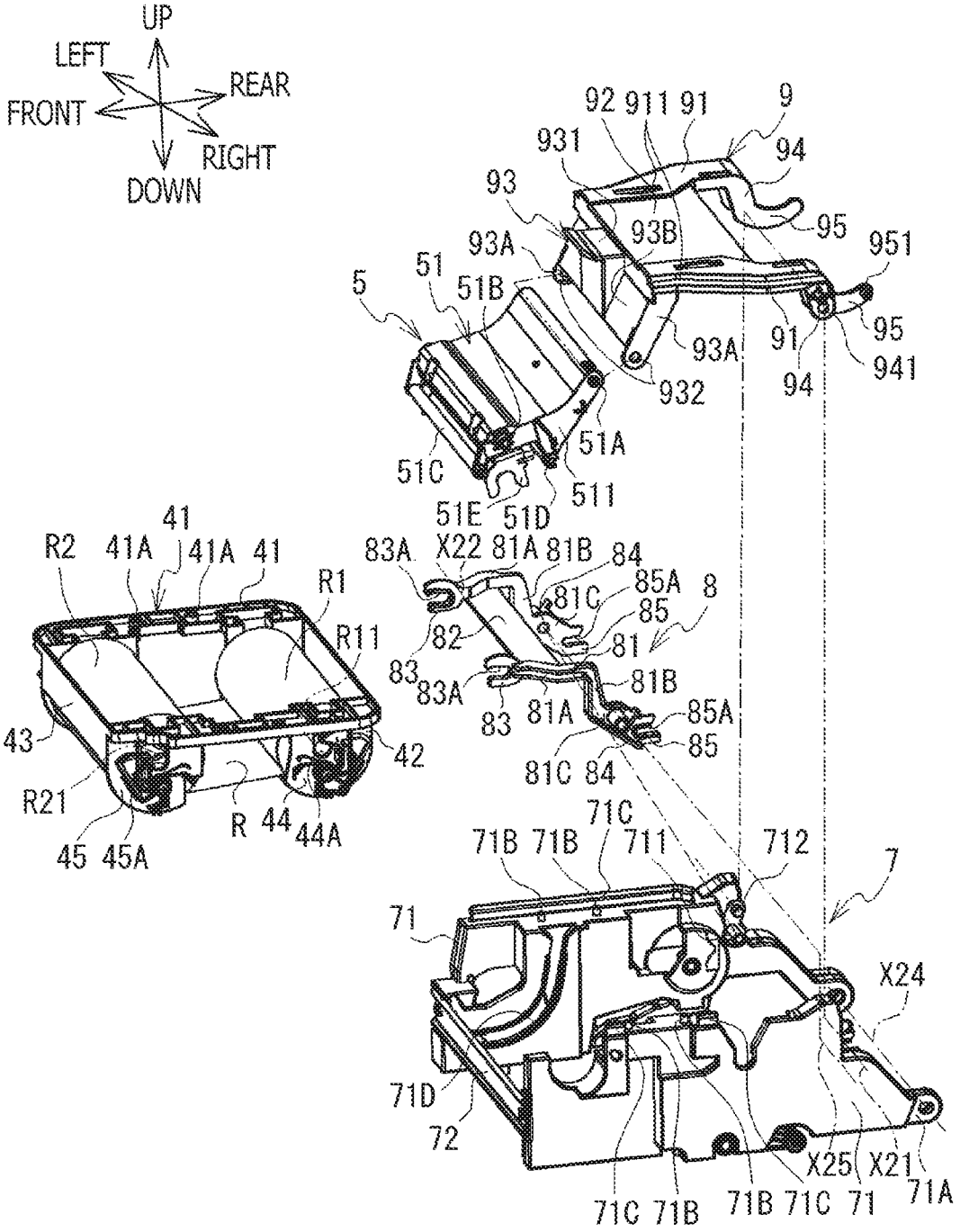

FIG. 16 is an exploded perspective view of the ink ribbon supporting member 7, a subsidiary arm 8, and a head arm 9 in the thermal-transfer printer 1B according to the second embodiment of the present disclosure.

Figure 17:
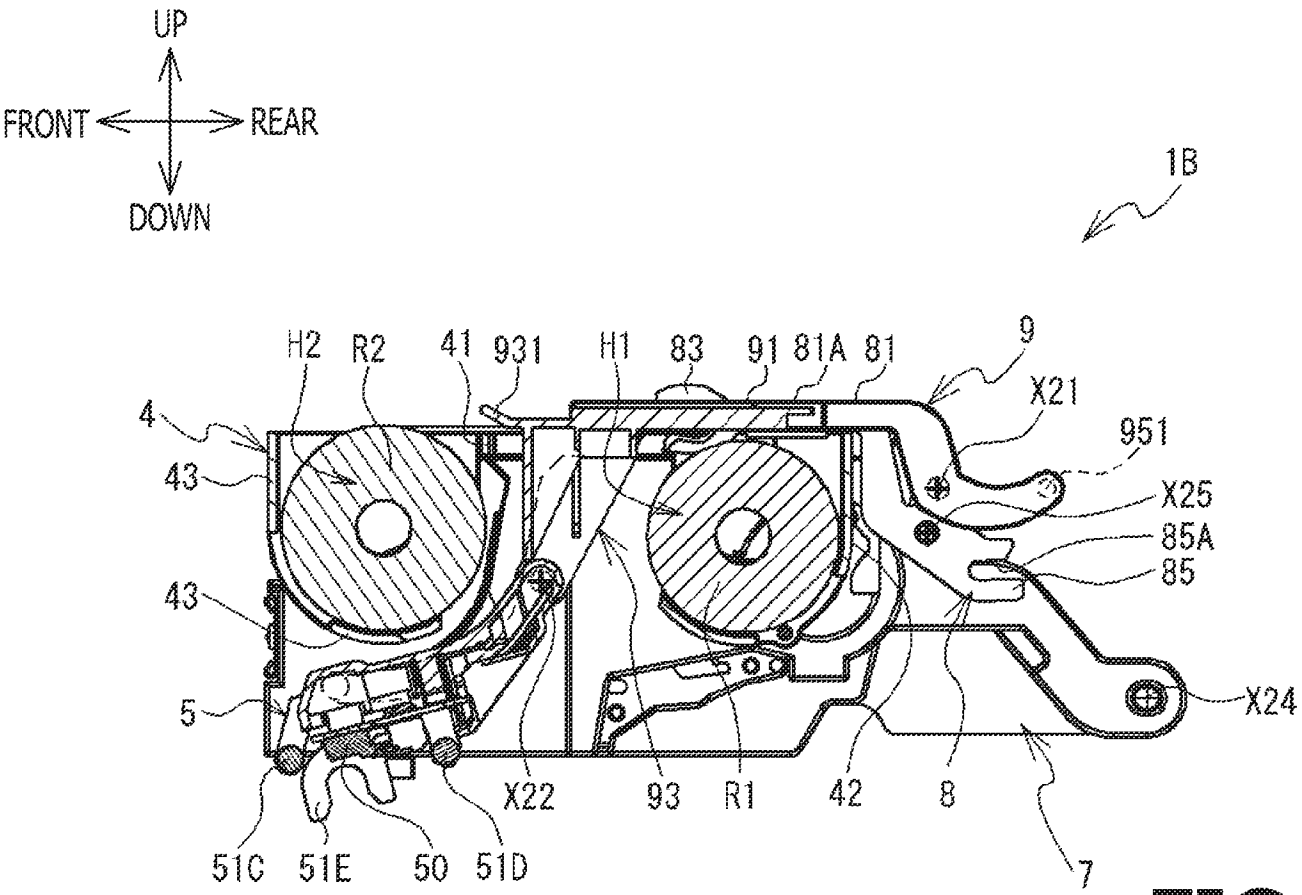

FIG. 17 is a sideward view of the ink ribbon supporting member 7 in the thermal-transfer printer 1B according to the second embodiment of the present disclosure with the head arm 9 at a first position.

Figure 18:
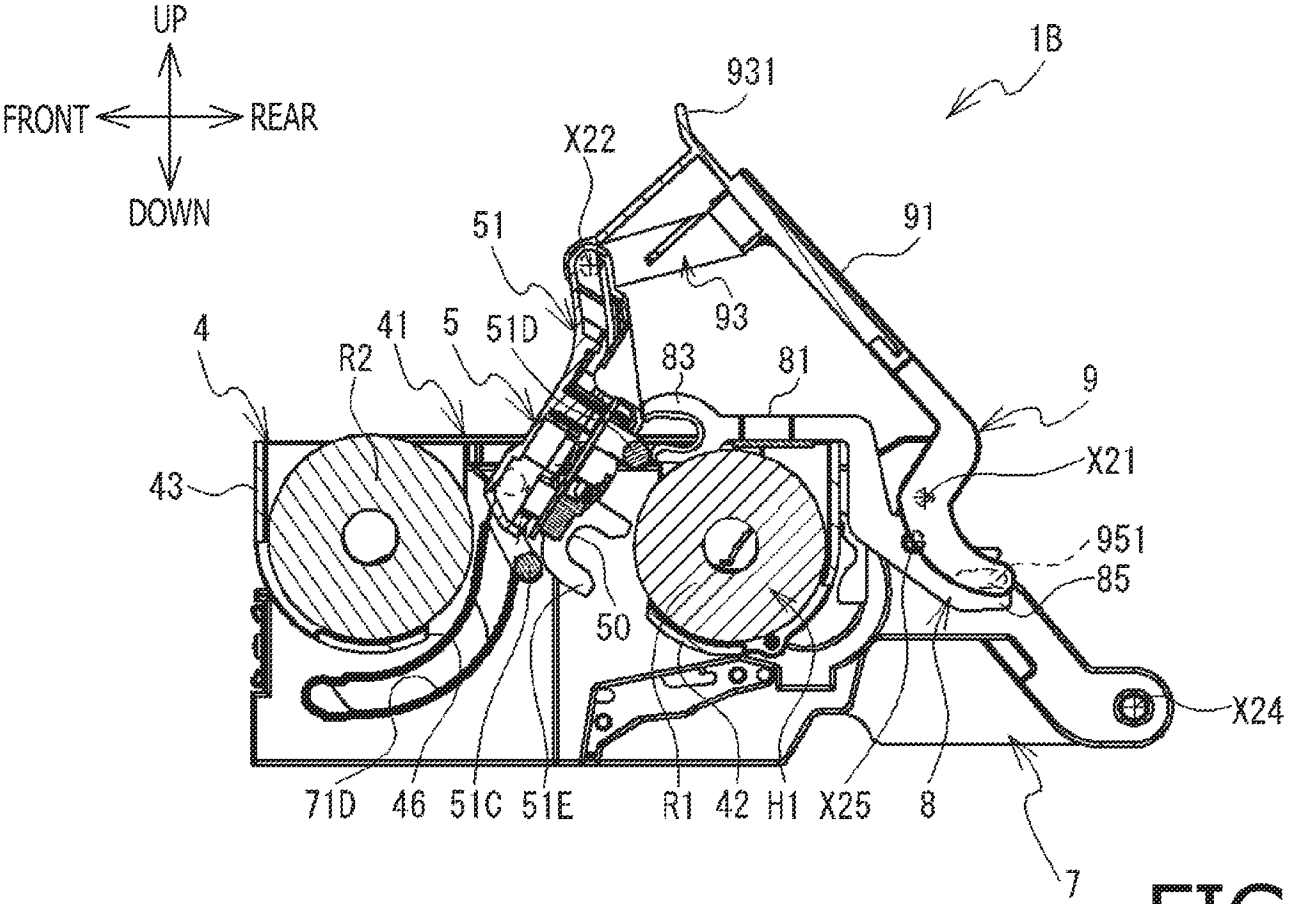

FIG. 18 is a sideward view of the ink ribbon supporting member 7 in the thermal-transfer printer 1B according to the second embodiment of the present disclosure with the head arm 9 at an interim position between the first position and a second position.

Figure 19:
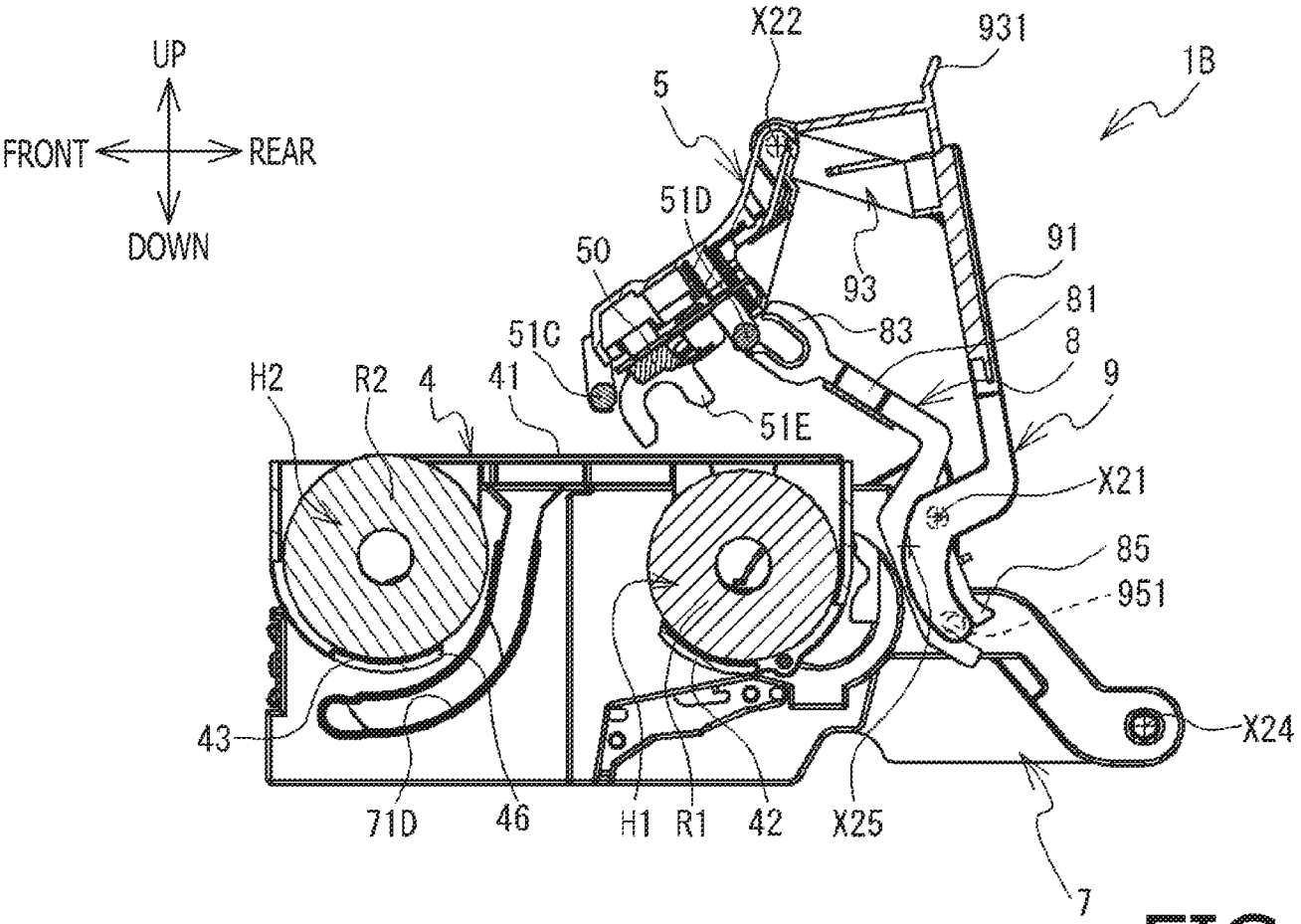

FIG. 19 is a sideward view of the ink ribbon supporting member 7 in the thermal-transfer printer 1B according to the second embodiment of the present disclosure with the head arm 9 at another interim position between the first position and a second position.

Figure 20:
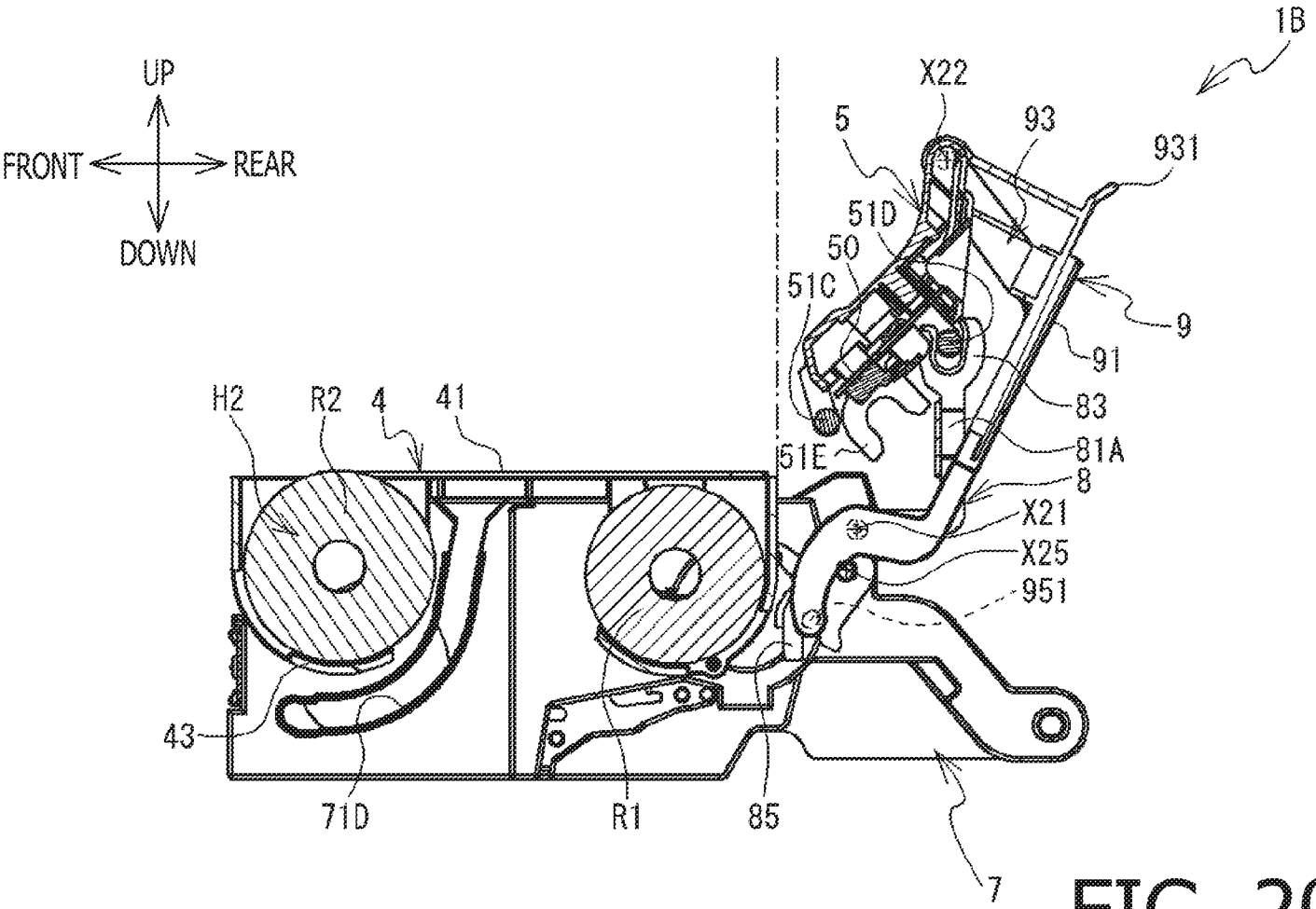

FIG. 20 is a sideward view of the ink ribbon supporting member 7 in the thermal-transfer printer 1B according to the second embodiment of the present disclosure with the head arm 9 at the second position.

Figure 21:
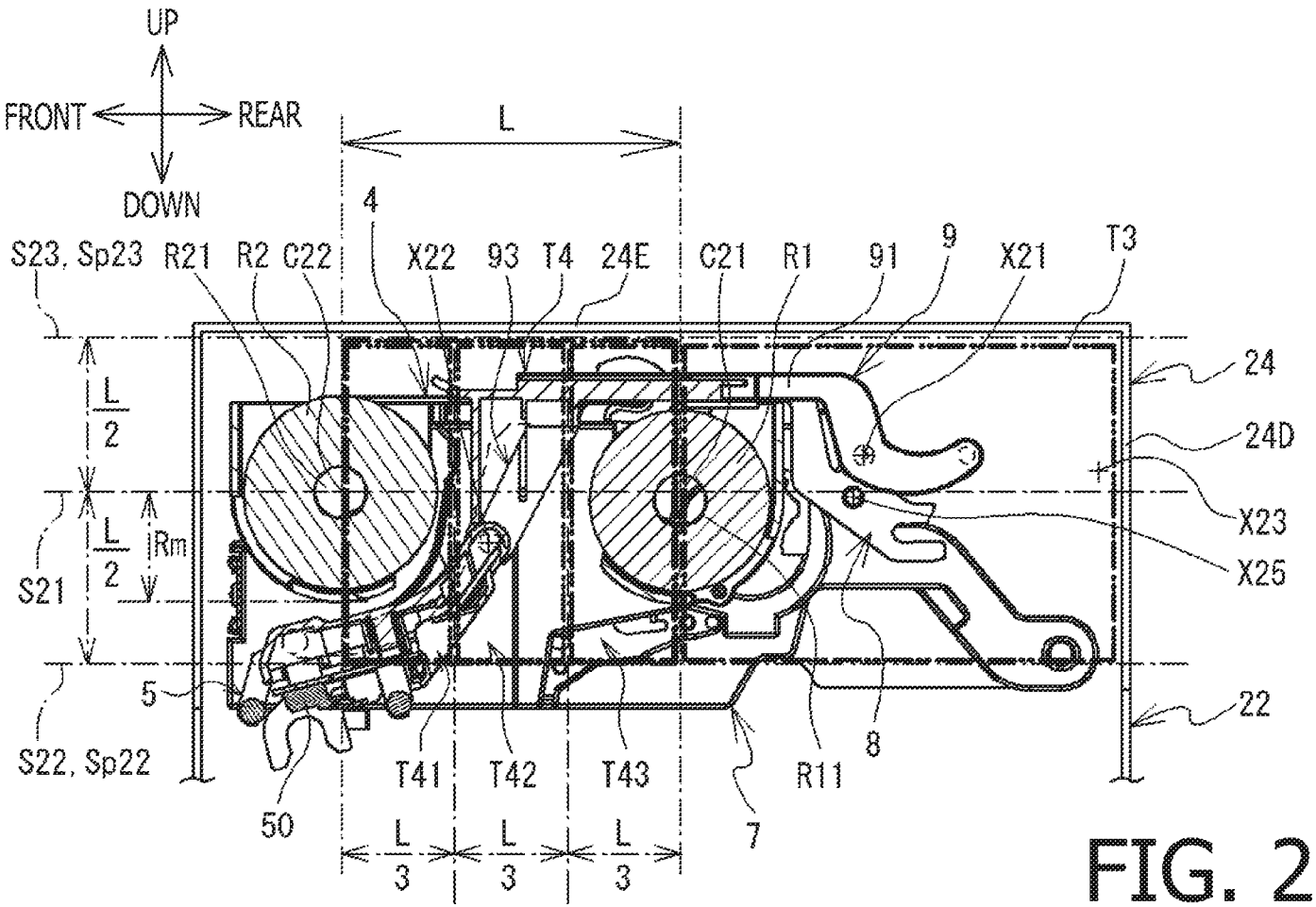

FIG. 21 is a cross-sectional view of the thermal-transfer printer 1B to illustrate relative positions of a first axis X21 and a second axis X22 according to the second embodiment of the present disclosure.

Figure 22:
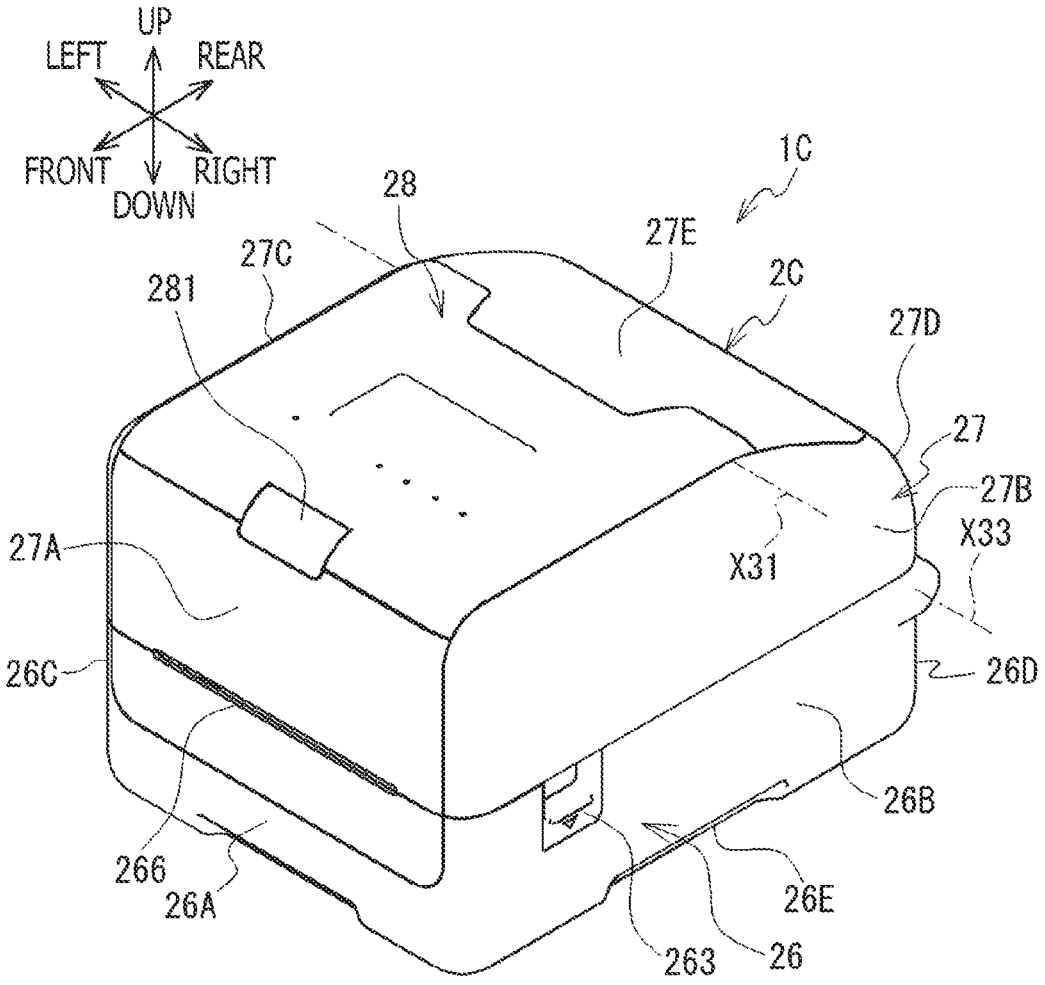

FIG. 22 is a perspective view of a thermal-transfer printer 1C according to a third embodiment of the present disclosure with a second case 27 at a third position (closed position) and a cover 28 at a first position (closed position).

Figure 23:
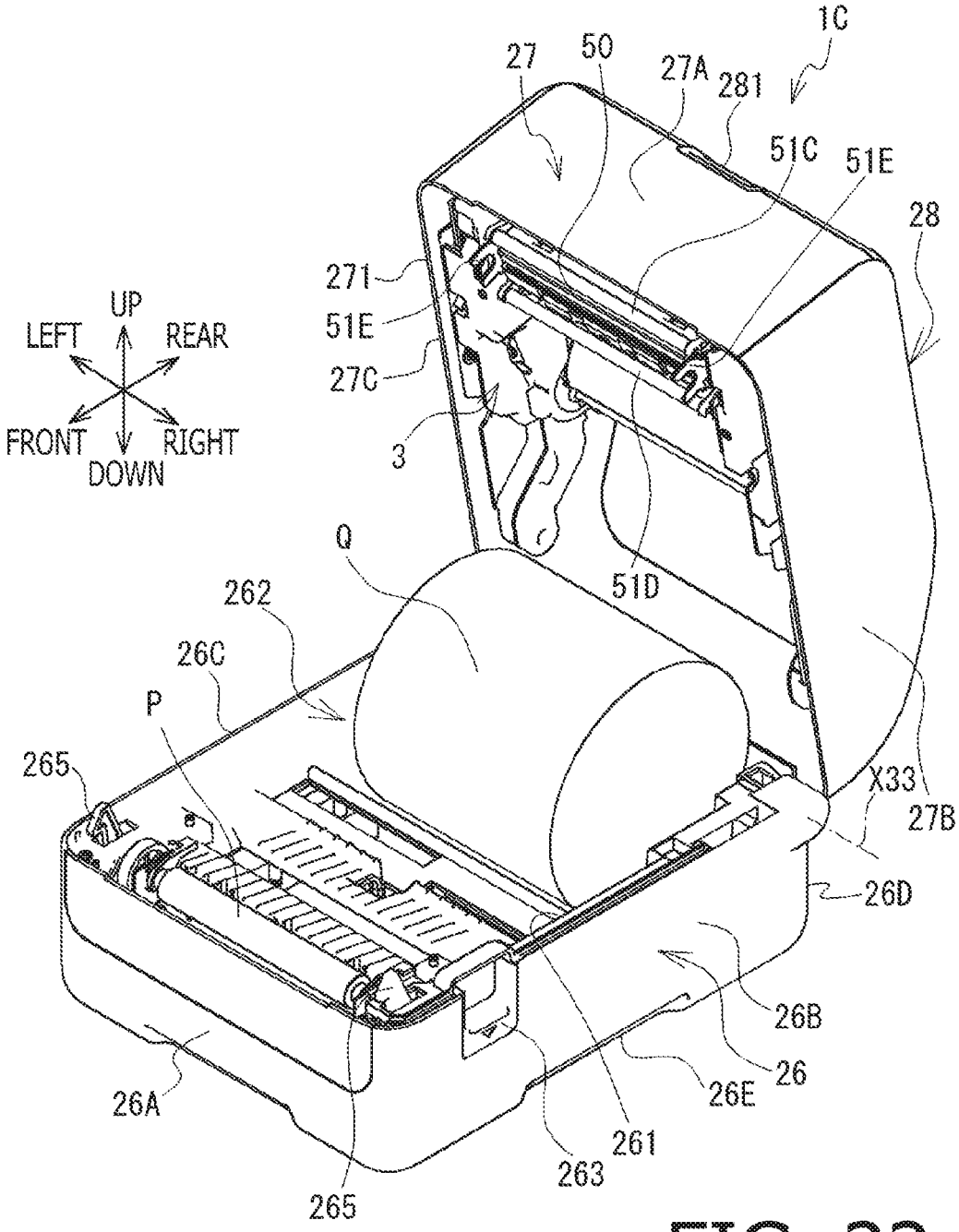

FIG. 23 is a perspective view of the thermal-transfer printer 1C according to the third embodiment of the present disclosure with the second case 27 at a fourth position (open position) and the cover 28 at the first position (closed position).

Figure 24:
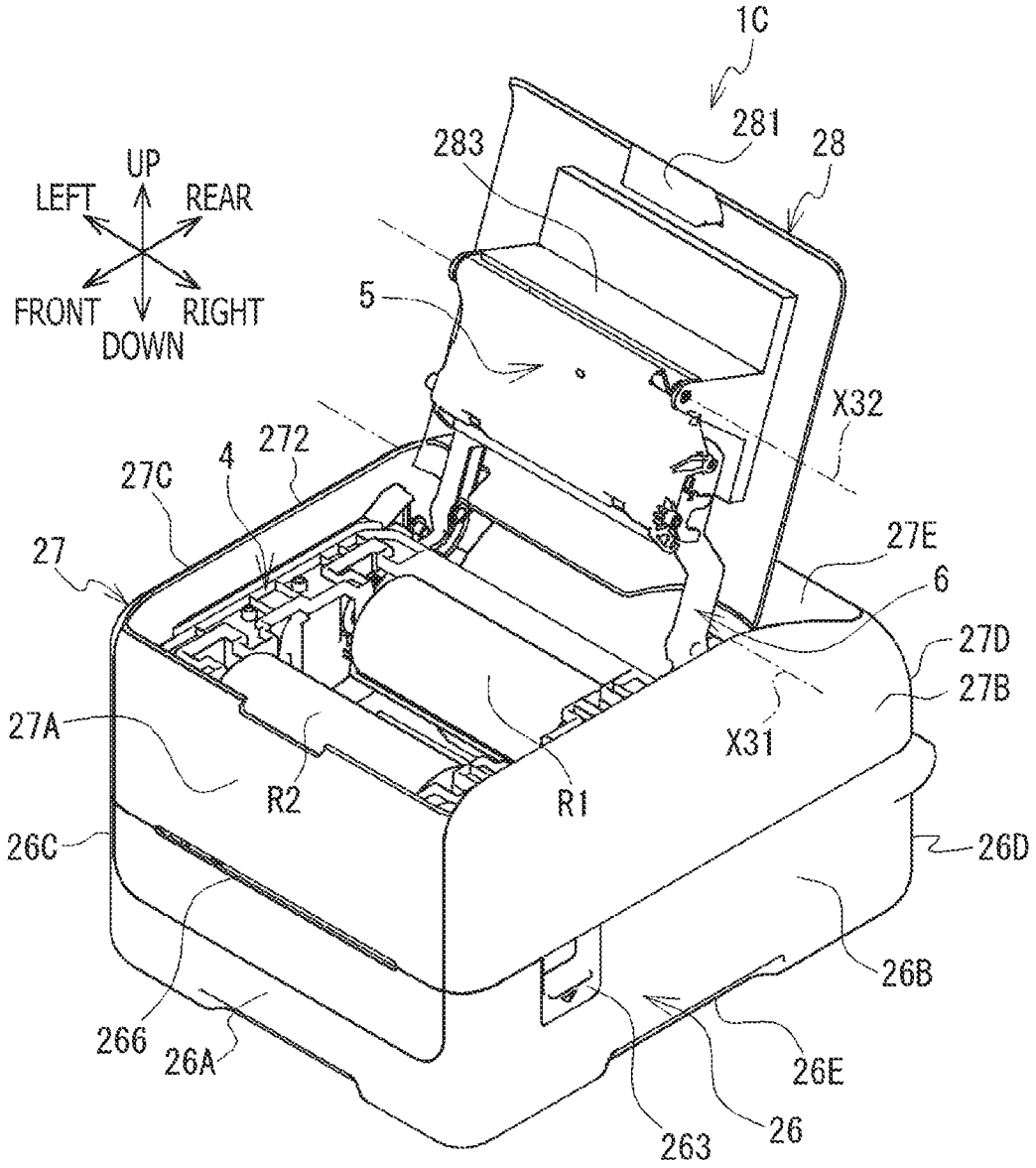

FIG. 24 is a perspective view of the thermal-transfer printer 1C according to the third embodiment of the present disclosure with the second case 27 at the third position (closed position) and the cover 28 at second position (open position).

Figure 25:
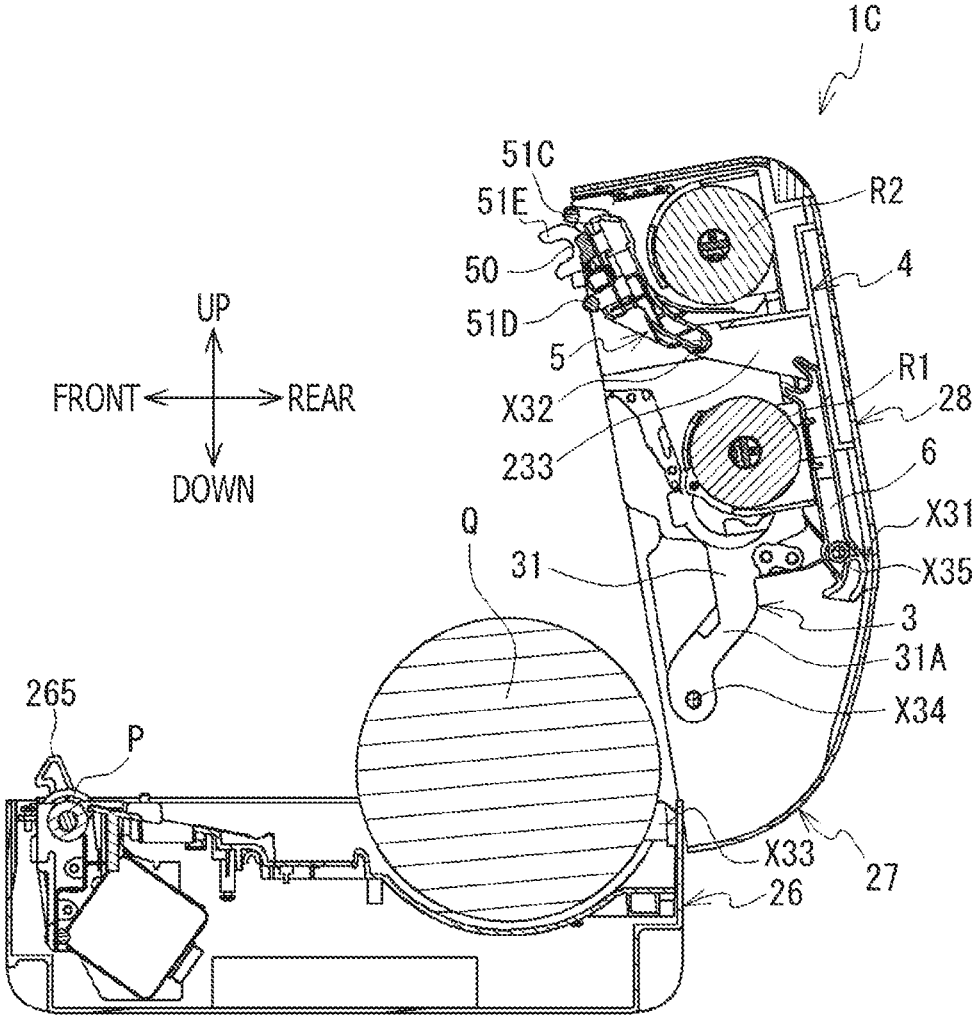

FIG. 25 is a cross-sectional view of the thermal-transfer printer 1C according to the embodiment of the present disclosure with the second case 27 at the fourth position (open position) and the cover 28 at the first position (closed position).

DETAILED DESCRIPTION

Hereinafter, embodiments of the present disclosure will be described with reference to the accompanying drawings.

First Embodiment

A thermal-transfer printer 1A according to a first embodiment of the present disclosure will be described in the following paragraphs. The thermal-transfer printer 1A may heat an ink ribbon R installed therein through a thermal head 50 to transfer ink on the ink ribbon R to a printing medium to print an image. In the following description, directions related the thermal-transfer printer 1A and parts and members included in the thermal-transfer printer 1A will be mentioned on basis of a posture of the thermal-transfer printer 1A with reference to arrows in each drawing. For example, in FIG. 1, sides of the thermal-transfer printer 1A on a viewer's lower-leftward direction, upper-rightward direction, lower-rightward direction, upper-leftward direction, upward direction, and downward direction correspond to a front side, a rear side, a right side, a left side, an upper side, and a lower side of the thermal-transfer printer 1A, respectively. A front-to-rear or rear-to-front direction may be expressed as a front-rear direction, an up-to-down or down-to-up direction may be expressed as a vertical direction, and a left-to-right or right-to-left direction may be expressed as a widthwise direction.

Case 2A

Figure 1:
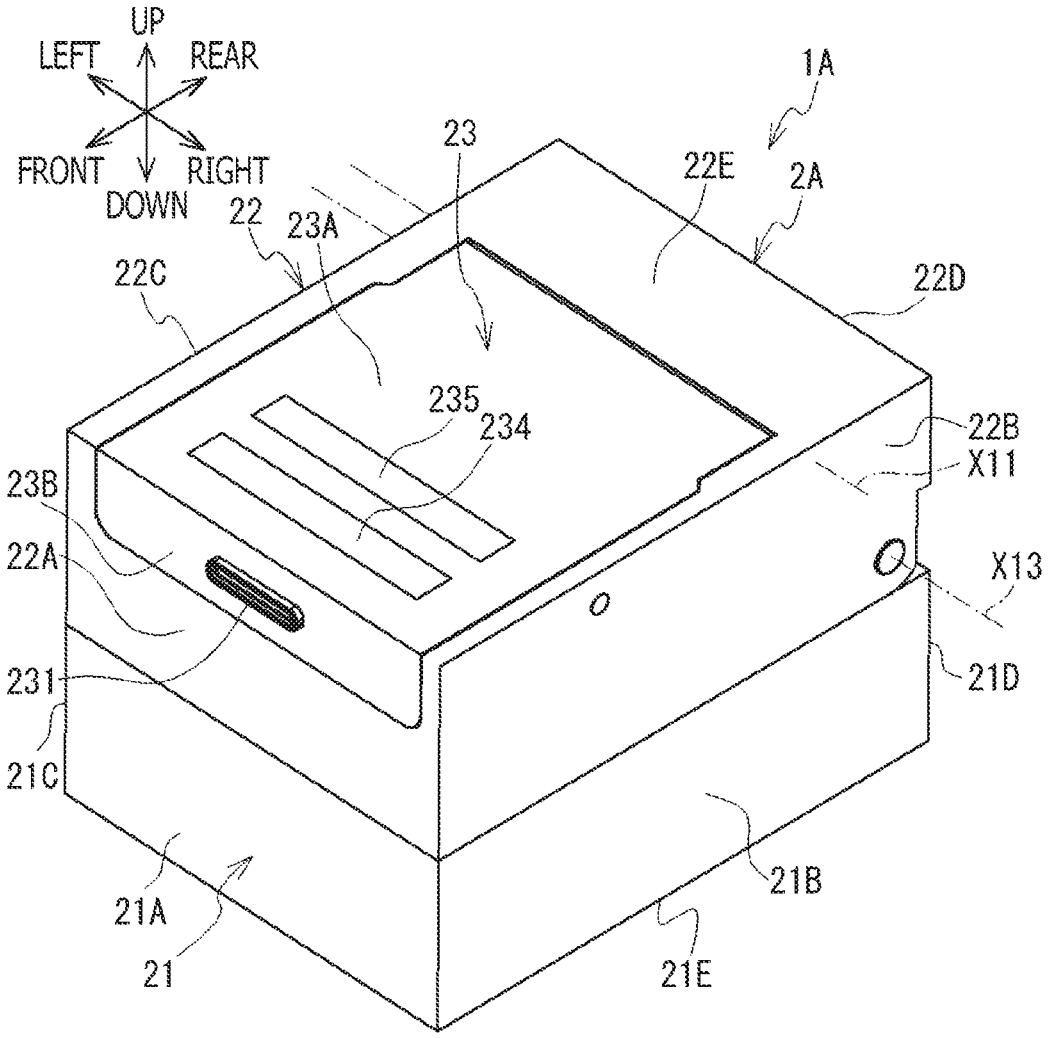
FIG. 1 is a perspective view of a thermal-transfer printer 1A according to a first embodiment of the present disclosure with a second case 22 at a third position (closed position) and a cover 23 at a first position (closed position).

As shown in FIG. 1, the thermal-transfer printer 1A includes a case 2A, which has an approximate shape of a rectangular box. The case 2A includes a first case 21, a second case 22, and a cover 23. The first case 21 has outer faces that form approximately lower halves of a frontward face, a rightward face, a leftward face, and a rearward face; and a bottom face of the thermal-transfer printer 1A. The second case 22 has outer faces that form approximately upper halves of the frontward face, the rightward face, the leftward face, and the rearward face; and a part of an upper face of the thermal-transfer printer 1A. An outer face of the cover 23 forms another part of the upper face of the thermal-transfer printer 1A. Thus, the first case 21, the second case 22, and the cover 23 form exterior faces of the thermal-transfer printer 1A.

Figure 2:
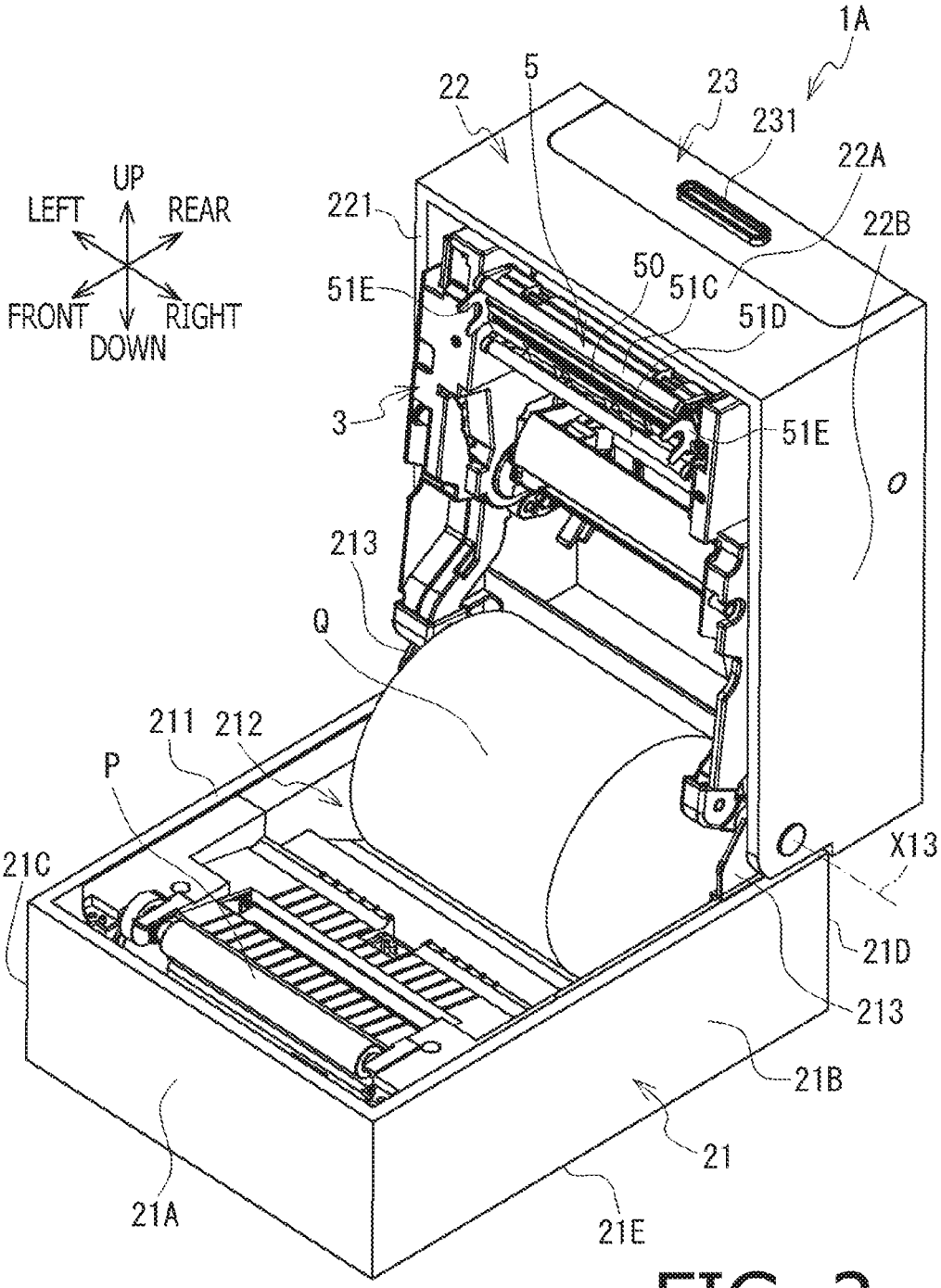
FIG. 2 is a perspective view of the thermal-transfer printer 1A according to the first embodiment of the present disclosure with the second case 22 at a fourth position (open position) and the cover 23 at the first position (closed position).

As shown in FIG. 2, the first case 21 includes walls 21A, 21B, 21C, 21D, 21E, which serve as a frontward wall, a rightward wall, a leftward wall, a rearward wall, and a bottom, respectively, of the first case 21. Upper ends of the walls 21A-21D form an opening 211 at an upper end of the first case 21. The first case 21 supports a platen roller P rotatably at a frontward position in an area enclosed by the walls 21A-21E. A rotation axis of the platen roller P extends in the widthwise direction. The first case 21 rotatably supports a medium roller Q, in which a printing medium in a form of a tape is wound into a roll, at a rearward position in the area enclosed by the walls 21A-21E. In the following paragraphs, the area inside the first case 21, in which the medium roll Q is stored, may be expressed as a medium storage 212.

The walls 21B, 21C each has a linkage 213 at a rearward position therein. The linkages 213, 213 protrude upward from upper ends of the walls 21B, 21C, respectively. The linkages 213 pivotably support the second case 22 and an ink ribbon supporting member 3, as will be described further below.

As shown in FIG. 1, the second case 22 is located at an upper position with respect to the first case 21. The second case 22 is movably supported by the linkages 213 on the first case 21 to pivot about a third axis X13, which extends in the widthwise direction. The second case 22 may pivot to open or close the opening 211 of the first case 21. FIG. 1 shows the second case 22 covering the opening 211 of the first case 21. In the following paragraphs, the position of the second case 22 covering the opening 211 as shown in FIG. 1 may be expressed as a third position (closed position). Meanwhile, FIG. 2 shows the second case 22 uncovering the opening 211 of the first case 21. In the following paragraphs, the position of the second case 22 uncovering the opening 211 as shown in FIG. 2 may be expressed as a fourth position (open position). In the following paragraphs, unless otherwise noted, directions related to the second case 22 will be based on the posture of the second case 22 being at the third position (closed position), as shown in FIG. 1 and as indicated by the arrows in FIG. 1.

Figure 3:
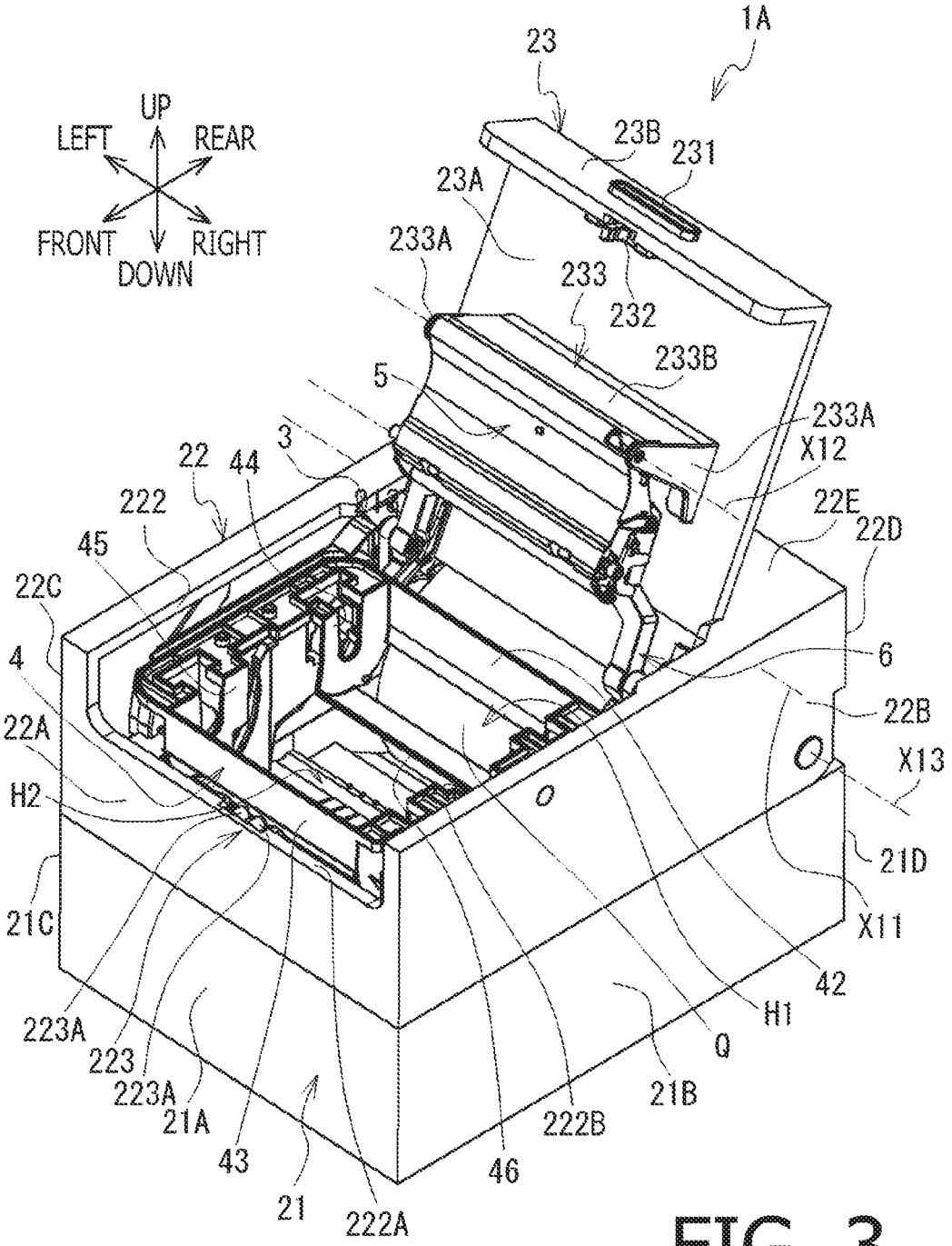
FIG. 3 is a perspective view of the thermal-transfer printer 1A according to the first embodiment of the present disclosure with the second case 22 at the third position (closed position) and the cover 23 at a second position (open position).

The second case 22 includes walls 22A, 22B, 22C, 22D, 22E, which serve as parts of a frontward wall, a rightward wall, a leftward wall, a rearward wall, and an upper wall, respectively, of the second case 22. Lower ends of the walls 22A-22D form an opening 221 (see FIG. 2) at a lower end of the second case 22. As shown in FIG. 3, a recessed portion 222A formed at an upper-end area in the wall 22A and a recessed portion 222B formed at a frontward area in the wall 22E form an opening 222 in the second case 22. The opening 222 is located in an upper area in the second case 22, when the second case 22 is at the third position (closed position). When the second case 22 is at the third position (closed position) to cover the opening 211 of the first case 21, the opening 211 at the upper end of the first case 21 and the opening 221 at the lower end of the second case 22 are connected to be at least partly continuous with each other.

As shown in FIG. 1, when the second case 22 is at the third position (closed position), a frontward surface of the wall 21A, a rightward surface of the wall 21B, a leftward surface of the wall 21C, a rearward surface of the wall 21D align flat on same vertical planes with a frontward surface of the wall 22A, a rightward surface of the wall 22B, a leftward surface of the wall 22C, and a rearward surface of the wall 22D, respectively, without forming different-leveled tiers. In other words, at joints between the wall 21A and the wall 22A, between the wall 21B and the wall 22B, between the wall 21C and the wall 22C, and between the wall 21D and the wall 22D, no substantial difference in depth or width is caused.

As shown in FIG. 3, the second case 22 has a locking device 223 at an upper end of the recessed portion 222A in the wall 22A. The locking device 223 includes two (2) locking members 223A, which are separated from each other in the widthwise direction but urged inward to be closer to each other.

The second case 22 may store an ink ribbon supporting member 3 and a cartridge case 4 therein. The ink ribbon supporting member 3 may be pivotably supported by the linkages 213 in the first case 21, and the cartridge case 4 may be attached to the ink ribbon supporting member 3. The ink ribbon supporting member 3 and the cartridge case 4 will be described further below.

As shown in FIGS. 1-3, the cover 23 may open or close the opening 222 of the second case 22. The cover 23 is movably supported by the second case 22 to pivot with respect to the second case 22 about a first axis X11, which extends in the widthwise direction through a rearward area with respect to the opening 222. The first axis X11 is located at a frontward position with respect to the third axis X13, which is the pivot axis for the second case 22. As shown in FIGS. 1 and 2, the cover 23 may cover and close the opening 222 of the second case 22. In the following paragraphs, the position of the cover 23 covering the opening 222 as shown in FIGS. 1 and 2 may be expressed as a first position (closed position). Meanwhile, as shown in FIG. 3, the cover 3 may open and uncover the opening 222 of the second case 22. In the following paragraphs, the position of the cover 23 uncovering the opening 222 as shown in FIG. 3 may be expressed as a second position (open position).

The second position (open position) for the cover 23 is, when the second case 22 is at the third position (closed position) (see FIG. 3), a position higher than the first position (closed position). In other words, the first position (closed position) is closer to the second case 22, and the second position (open position) is farther from the second case 22. While the cover 23 is at the second position (open position), and while the ink ribbon supporting member 3 is stored in the second case 22 (see FIG. 3), the cartridge case 4, as will be described further below, is exposed to the outside through the opening 222. While the cover 23 is at the first position (closured position) (see FIG. 1), the cartridge case 4 is covered by the cover 23 from an upper side: in other words, the cover 23 covers an upper side of the cartridge case 4. In the following paragraphs, unless otherwise noted, directions related to the cover 23 will be based on the posture of the cover 23 being at the first position (closed position) while the second case 22 is at the third position (closed position), as shown in FIG. 1 and as indicated by the arrows in FIG. 1.

As shown in FIG. 1, the cover 23 includes walls 23A, 23B. The wall 23A has a shape substantially identical with an outline of the recessed portion 222A (see FIG. 3) in the second case 22. The wall 23A is pivotably supported by the second case 22 at a rearward end portion thereof. The wall 23B has a shape substantially identical with an outline of the recessed portion 222B (see FIG. 3) in the second case 22. The wall 23B extends, in a posture where the cover 23 is at the first position (closed position), downward from a front end of the wall 23A. In other words, a frontward portion of the cover 23 bends downward in the posture where the cover 23 is at the first position (closed position).

On a frontward face of the wall 23B in the cover 23, arranged is a handle 231 protruding frontward. As shown in FIG. 3, at a lower end of the wall 23B, arranged is a protrusion 232 protruding downward. The protrusion 232 is, when the cover 23 is at the first position (closed position) (see FIG. 1), located between the two locking members 223A in the locking device 223 in the second case 22. While the locking members 223A are urged inward, the protrusion 232 arranged between the locking members 223A is restricted from separating from the locking members 223A. Therefore, the cover 23 may stay at the first position (closed position) without pivoting to the second position (open position).

As shown in FIG. 1, the cover 23 has an operation interface 234 and a display 235 on an upper face of the wall 23A. The operation interface 234 includes buttons (not shown), through which commands from a user may be entered. The display 235 includes a displaying device such as, for example, an organic electro luminescence (EL). The display 235 may include a touch panel.

As shown in FIG. 3, on a lower face, i.e., an inner face, of the wall 23A of the cover 23, arranged is a linkage 233. The linkage 233 protrudes downward from the lower face of the wall 23A at a central position in the front-rear direction in the cover 23. The linkage 233 includes two (2) side plates 233A, which are spaced apart from each other in the widthwise direction, and a bridged portion 233B, which extends between the side plates 233A. The side plates 233A spread orthogonally to the widthwise direction. At a lower end of each side plate 233A, bored through in the widthwise direction is a hole (unsigned). The linkage 233 pivotably supports a head holder 5, as will be described further below, at the lower ends of the side plates 233A.

Head Holder 5 and Thermal Head 50

Figure 4:
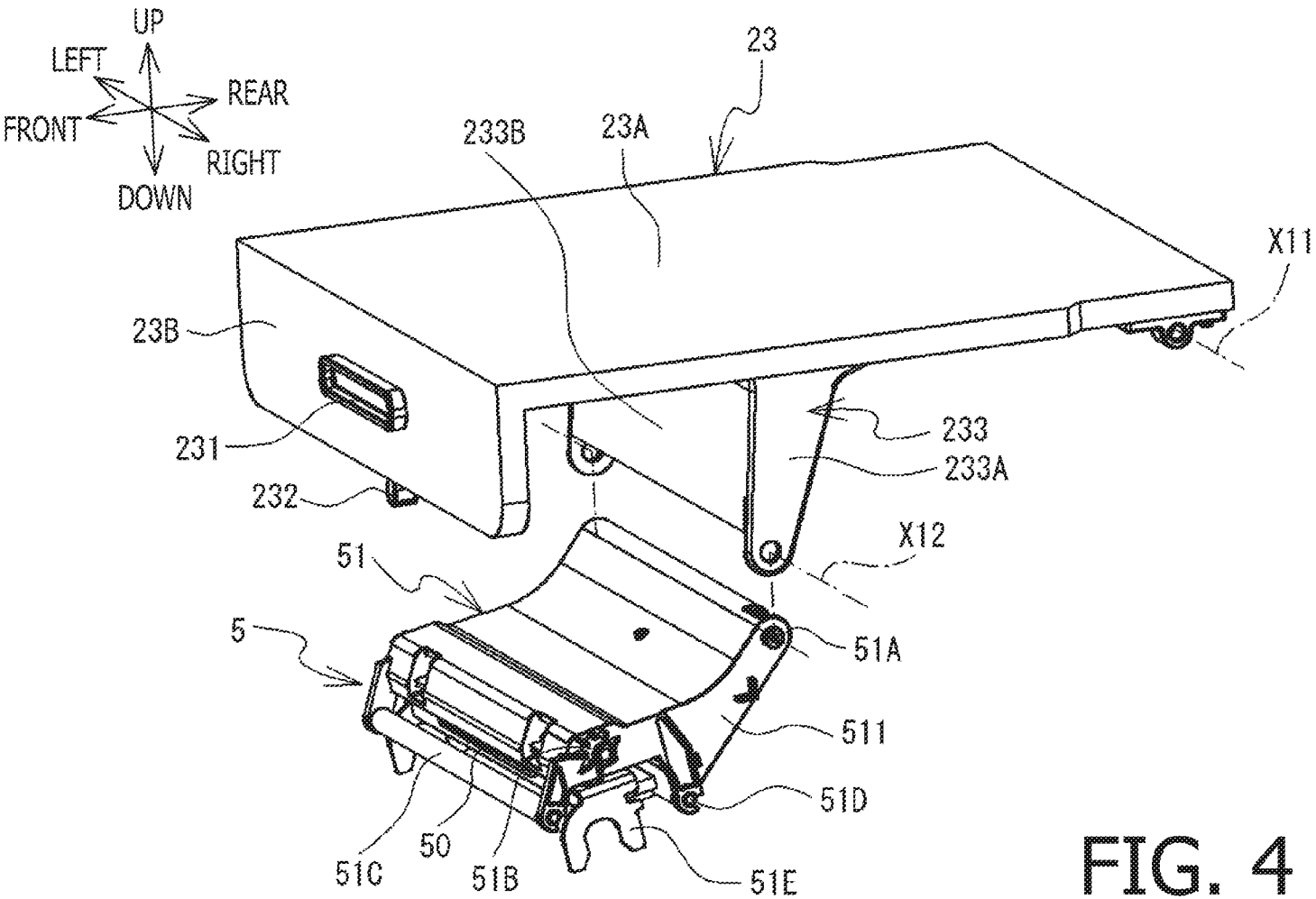
FIG. 4 is an exploded perspective view of the cover 23 and a head holder 5 in the thermal-transfer printer 1A according to the first embodiment of the present disclosure.

As shown in FIG. 4, the head holder 5 includes a base 51, two (2) protrusive portions 51A, two (2) protrusive portions 51B, conveyer rollers 51C, 51D, and two (2) fitting portions 51E. The base 51 has sidewalls 511, which spread orthogonally to the widthwise direction, at widthwise ends thereof. At a widthwise end of each sidewall 511, arranged is the protrusive portion 51A, which protrudes outward in the widthwise direction. The protrusive portions 51A are inserted outward in the widthwise direction into the holes formed in the side plates 233A in the linkage 233. The base 51 is pivotably supported by the cover 23 at end areas on one side thereof in the front-rear direction. The base 51 may pivot about a second axis X12, which extends in the widthwise direction through the holes formed in the side plates 233A. At end areas on a side opposite to the protrusive portions 51A in the front-rear direction in the sidewalls 511, arranged are the protrusive portions 51B protruding outward in the widthwise direction.

The head holder 5 may pivot about the second axis X12 in conjunction with the cover 23 moving between the first position (closed position) and the second position (open position). FIG. 4 shows a posture of the head holder 5 when the second case 22 is at the third position (closed position) and the cover 23 is at the first position (closed position) (see FIG. 1). In the following paragraphs, unless otherwise noted, directions related to the head holder 5 will be based on the posture of the cover 23 being at the first position (closed position) while the second case 22 is at the third position (closed position), as shown in FIG. 1 and as indicated by the arrows in FIG. 4.

The base 51 holds the thermal head 50 on a lower face thereof at a lower position with respect to the protrusive portions 51B. The thermal head 50 extends longitudinally in the widthwise direction between the sidewalls 511. The thermal head 50 may be a liner thermal head, which has a plurality of heating elements aligned in line in the widthwise direction on a heater surface thereof. In the posture shown in FIG. 4, the heater surface of the thermal head 50 faces downward. The base 51 has the fitting portions 51E at the widthwise ends thereof. The fitting portions 51E are plate members each having a recessed area. The recessed area is formed to recess upward from a lower end of each fitting portion 51E.

The base 51 holds the conveyer roller 51C and the conveyer roller 51D at a frontward position and a rearward position with respect to the thermal head 50, respectively. In other words, the conveyer roller 51C and the conveyer roller 51D are located in proximity to the thermal head 50, on a frontward side and a rearward side of the thermal head 50, respectively. The conveyer roller 51D is arranged on the base 51 at a position between a location of the thermal head 50 and a position of the protrusive portions 51A, which is the position of the second axis X12. The conveyer rollers 51C, 51D each has a cylindrical shape extending in the widthwise direction. The conveyer rollers 51C, 51D are rotatably supported by the base 51.

Ink Ribbon Supporting Member 3

As shown in FIG. 3, to the ink ribbon supporting member 3, the cartridge case 4 may be attached from an upper side. The cartridge case 4 holds ribbon rolls R1, R2 (see FIG. 5), which are rolls of an ink ribbon R (see FIG. 5). In other words, to the ink ribbon supporting member 3, the ink ribbon R rolled into the ribbon rolls R1, R2 and held by the cartridge case 4 is attachable.

The ink ribbon supporting member 3 is stored in the second case 22 and attached to an interior of the second case 22. In particular, the ink ribbon supporting member 3 may be supported pivotably by the linkage 213 in the first case 21 (see FIGS. 2 and 3). FIG. 2 shows the ink ribbon supporting member 3 stored in the second case 22, which is at the fourth position (open position). FIG. 3 shows the ink ribbon supporting member 3 stored in the second case 22, which is at the third position (closed position). In the following paragraphs, unless otherwise noted, directions related to the ink ribbon supporting member 3 will be based on the posture of the ink ribbon supporting member 3 stored in the second case 22 being at the third position (closed position), as shown in FIG. 3 and as indicated by the arrows in FIG. 3.

As shown in FIGS. 2 and 3, the ink ribbon supporting member 3 may be stored inside the second case 22. When the second case 22 is at the third position (closed position), a part of the ink ribbon supporting member 3 in a rearward area is located to be higher than the medium storage 212 (see FIG. 2) in the first case 21 (see FIG. 6). Meanwhile, another part of the ink ribbon supporting member 3 in a frontward area is located to be lower than the cover 23 (see FIG. 1) being at the first position (closed position) (see FIG. 6).

As shown in FIG. 5, the ink ribbon supporting member 3 includes two (2) sidewalls 31 and a bridged portion 32. The sidewalls 31 each has a shape of a plate spreading orthogonally to the widthwise direction and are spaced apart from each other in the widthwise direction. A distance between the sidewalls 31 is substantially equal to a distance between the walls 22B, 22C (see FIG. 3) of the second case 22. The sidewalls 31 on the right and the left are located in proximity to inner surfaces of the wall 22B and the wall 22C, respectively (see FIG. 3). The bridged portion 32 extends between frontward portions of the sidewalls 31.

Each sidewall 31 has an extended portion 31A, which extends upper-rearward from a rearward area in the sidewall 31. Rearward ends of the extended portions 31A are connectable with the linkages 213 (see FIG. 2) in the first case 21 pivotably to pivot about a fourth axis X14, which extends in the widthwise direction. Meanwhile, a position of the fourth axis X14 is different from the position of the third axis X13 (see FIG. 2), which is the pivot axis for the second case 22 pivotably supported by the linkages 213.

On an upper edge of each sidewall 31, at frontward positions with respect to a center of the sidewall 31 in the front-rear direction, arranged are protrusive portions 31B. Each protrusive portion 31B has a cylindrical shape protruding upward from the upper edge of the sidewall 31. The protrusive portions 31B on each sidewall 31 are spaced apart from each other in the front-rear direction. On the upper edge of each sidewall 31, at an outer position with respect to each protrusive portion 31B, arranged is a protrusive portion 31C. Each protrusive portion 31C has a shape of a plate, which protrudes upward from the upper edge of the sidewall 31. One of the protrusive portions 31C on the sidewall 31 on the left extends longitudinally from a frontward end position to a rearward end position on the upper edge of the sidewall 31. The sidewall 31 on the right has two (2) protrusive portions 31, which are arranged on the upper edge at a frontward position with respect to one of the protrusive portions 31B and at a rearward position with respect to the other of the protrusive portions 31B.

On an inner face of each sidewall 31, at a frontward position with respect to the center of the sidewall 31 in the front-rear direction, formed is a guide 31D being a groove. The guide 31D is formed to curve in an arc. The guide 31D extends downward from a position between the protrusive portions 31B, which are arranged on the upper edge of the sidewall 31, curving to extend frontward. Each guide 31D is formed to be widened at an upper part thereof in proximity to the upper edge of the sidewall 31 to be wider at a higher position. The guides 31D are engageable with the protrusive portions 51B of the head holder 5 (see FIG. 4), as will be described further below.

Each sidewall 31 has an extended portion 31E, which extends upward from the upper edge of the sidewall 31 at a rearward position with respect to the protrusive portion 31C. At a tip end of each extended portion 31E, arranged is a protrusive portion 311 in a cylindrical shape protruding inward in the widthwise direction. The protrusive portion 311 may pivotably support a subsidiary arm 6, which will be described further below.

Cartridge Case 4 and Ink Ribbon R

As shown in FIG. 3, the cartridge case 4 is attachable to the ink ribbon supporting member 3 from an upper side to be used. In the following paragraphs, unless otherwise noted, directions related to the cartridge case 4 will be based on the posture of the cartridge case 4 being attached to the ink ribbon supporting member 3, which is stored in the second case 22 at the third position (closed position), as shown in FIG. 3 and as indicated by the arrows in FIG. 3.

As shown in FIG. 5, the cartridge case 4 has two (2) extended portions 41, bridged portions 42, 43, two (2) first sidewalls 44, and two (2) second sidewalls 45. The extended portions 41 extend in the front-rear direction and are spaced apart from each other in the widthwise direction. Each first sidewall 44 has a shape of a plate, of which lower end is rounded, and extends downward from a rearward position in each extended portion 41. Each first sidewall 44 has a recessed portion 44A, which is recessed downward from an upper end of the first sidewall 44. The bridged portion 42 has a shape of a plate and extends between rearward ends of the first sidewalls 44. In the following paragraphs, an area enclosed by the first sidewalls 44 and the bridged portion 42 will be expressed as a ribbon storage H1 (see FIG. 3). Each second sidewall 45 has a shape of a plate, of which lower end is rounded, and extends downward from a frontward position in each extended portion 41. Each second sidewall 45 has a recessed portion 45A, which is recessed downward from an upper end of the second sidewall 45. The bridged portion 43 has a shape of a plate and extends between frontward ends of the second sidewalls 45. In the following paragraphs, an area enclosed by the second sidewalls 45 and the bridged portion 43 will be expressed as a ribbon storage H2 (see FIG. 3). At a lower end of the cartridge case 4, and at a position between the bridged portion 42 and the bridged portion 43, formed is an opening 46 (see FIG. 3), of which outline forms a rectangle.

Each extended portion 41 has two (2) holes 41A in an intermediate area between areas, at which the first sidewall 44 is connected to the extended portion 41 and at which the second sidewall 45 is connected to the extended portion 41. Each hole 41A has a round outline. A distance between the holes 41A in each extended portion 41 is equal to a distance between the protrusive portions 31B arranged in the ink ribbon supporting member 3.

The ink ribbon R is attached to and rolled around a first spool R11 at one end and attached to and rolled around a second spool R21 at the other end. In the following paragraphs, a part of the ink ribbon R rolled around the first spool R11 will be expressed as a ribbon roll R1, and another part of the ink ribbon R rolled around the second spool R21 will be expressed as a ribbon roll R2.

The ribbon roll R1 may be stored in the cartridge case 4 as the first spool R11 is placed in the recessed portions 44A, 44A formed in the first walls 44 on the right and the left, respectively, from an upper side. The ribbon roll R2 may be stored in the cartridge case 4 as the second spool R21 is placed in the recessed portions 45A, 45A formed in the second walls 45 on the right and the left, respectively, from the upper side. The ribbon roll R1 is stored in the ribbon storage H1, and the ribbon roll R2 is stored in the ribbon storage H2. Axial centers of the first spool R11 and the second spool R21 extend in the widthwise direction and are apart from each other for a predetermined distance L in the front-rear direction. The first spool R11 is located at a rearward position with respect to the second spool R21. In other words, the first spool R11 is located on a side closer to the rear in the front-rear direction, and the second spool R21 is located on the other side farther from the rear in the front-rear direction, within the cartridge case 4. The first spool R11 and the second spool R21 are rotatably supported by the cartridge case 4. The ink ribbon R extends between the ribbon roll R1 and the ribbon roll R2 to cross over the opening 46 (see FIG. 3) at the lower end of the cartridge case 4. The first spool R11 and the second spool R21 may rotate in a direction such that the ink ribbon R is unwound from the ribbon roll R1 and wound around the ribbon roll R2. Therefore, as the ink ribbon R is rolled from the ribbon roll R1 to the ribbon roll R2, the extended part of the ink ribbon R between the ribbon roll R1 and the ribbon roll R2 may move frontward. The moving direction for the ink ribbon R is the same as a moving direction for the printing medium, which is rolled out from the medium roll Q (see FIG. 2), as an image is being printed in the thermal-transfer printer 1A.

The cartridge case 4 is attachable to the ink ribbon supporting member 3 to be installed in a frontward area with respect to a center in the front-rear direction in the ink ribbon supporting member 3 from the upper side. In other words, the ink ribbon supporting member 3 may accept the cartridge case 4 with the ink ribbon R to be attached thereto from the upper side. When attached to the ink ribbon supporting member 3, lower ends of the extended portions 41 in the cartridge case 4 contact the upper ends of the sidewalls 31 in the ink ribbon supporting member 3, and the protrusive portions 31B on the ink ribbon supporting member 3 fit in the holes 41A in the cartridge case 4 (see FIG. 3). The extended portions 41 in the cartridge case 4 are flanked sideward by the protrusive portions 31C in the ink ribbon supporting member 3 from the outer sides in the widthwise direction.

Subsidiary Arm 6

The subsidiary arm 6 is pivotably supported by the ink ribbon supporting member 3. The subsidiary arm 6 may pivot about a fifth axis X15 (see FIG. 5) as the head holder 5 moves in response to a pivoting motion of the cover 23. FIG. 3 shows the subsidiary arm 6 when the cover 23 is at the second position (open position). FIG. 5 shows the subsidiary arm 6 when the cover 23 is at the first position (closed position). In the following paragraphs, unless otherwise noted, directions related to the subsidiary arm 6 will be based on the posture of the subsidiary arm 6 when the cover 23 is at the first position (closed position), as shown in FIG. 5 and as indicated by the arrows in FIG. 5.

As shown in FIG. 5, the subsidiary arm 6 has two (2) extended portions 61 and a bridged portion 62. The extended portions 61 extend in the front-rear direction. The extended portions 61 are spaced apart from each other in the widthwise direction. The extended portions 61 are bended at a central area in the front-rear direction so that a distance between the extended portions 61 in the widthwise direction at a frontward area is shorter than a distance between the extended portions in the widthwise direction at a rearward area. The bridged portion 62 has an approximate shape of a plate, which is extended between central areas in the extended portions 61 in the front-rear direction.

Each extended portion 61 has a second engageable portion 63 at the frontward area therein. The second engageable portion 63 is formed to have a recessed portion 63A, which is recessed upper-rearward from a lower-frontward end of the second engageable portion 63. The second engageable portion 63 is engageable with the conveyer roller 51D (see FIG. 4) in the head holder 5. At a rearward area in the extended portion 61, formed through in the widthwise direction is a hole 64. The protrusive portions 311 in the ink ribbon supporting member 3 are inserted in the holes 64 inward in the widthwise direction from the widthwise outer side. The subsidiary arm 6 is pivotably supported by the ink ribbon supporting member 3 to pivot about the fifth axis X15, which extends in the widthwise direction, at the rearward areas in the extended portions 61.

Opening Motion of Cover 23

With reference to FIGS. 6-8, described below will be behaviors of the movable items in the thermal-transfer printer 1A when the cover 23 moves from the first position (closed position) to the second position (open position). The following description will be based on a condition where the second case 22 is maintained at the third position (closed position), and the ribbon rolls R1, R2 are not stored in the cartridge case 4. The motions may occur when, for example, a user opens the cover 23 in order to store the ribbon rolls R1, R2 in the unoccupied cartridge case 4, which is attached to the ink ribbon supporting member 3.

FIG. 6 shows the cover 23 located at the first position (closed position). The linkage 233 extending downward from the cover 23 is located between the ribbon storages H1, H2 in the cartridge case 4. The protrusive portions 51B (see FIG. 4) in the head holder 5 are located at lower ends of the guides 31D in the ink ribbon supporting member 3. The second axis X12 being the pivot axis for the head holder 5 is located between the ribbon storages H1, H2. The head holder 5 extends downward through opening 46 at the lower end of the cartridge case 4 to be located at a lower position with respect to the ribbon storage H2. The heater surface of the thermal head 50 faces downward toward the platen roller P at an upper position with respect to the platen roller P. The fitting portions 51E in the head holder 5 are placed to fit in bearings (not shown), which are located at widthwise end areas in the platen roller P, from an upper side. Thus, a position of the thermal head 50 with respect to the platen roller P may be maintained. A direction of the head holder 5 extending from the second axis X12 toward the thermal head 50 inclines with respect to the vertical direction, in a view from the right, lower-frontward. In the following paragraphs, the position of the head holder 5 in this posture as shown in FIG. 6 will be expressed as a printable position.

The subsidiary arm 6 is placed to longitudinally extend along the upper ends of the extended portions 41 (see FIG. 5) of the cartridge case 4. The subsidiary arm 6 extends horizontally between the fifth axis X15, which is the pivot axis thereof, and the second engageable portions 63. In the following paragraphs, the position of the subsidiary arm 6 in this posture as shown in FIG. 6 will be expressed as a fifth position. When the subsidiary arm 6 is at the fifth position, the second engageable portions 63 are separated from the conveyer roller 51D. When the subsidiary arm 6 is at the fifth position, the subsidiary arm 6 staying on the upper ends of the extended portions 41 of the cartridge case 4 may be restricted from moving downward.

FIG. 7 shows a transitive posture of the cover 23 being in transition to pivot from the first position (closed position) toward the second position (open position). The fitting portions 51E in the head holder 5 are separated from the bearings of the platen roller P. The protrusive portions 51B (see FIG. 4) in the head holder 5 moved along the guides 31D in the ink ribbon supporting member 3 reach the upper end areas in the guides 31D. The linkage 233 moved upward is located to be higher than the ink ribbon supporting member 3, and the second axis X12 being the pivot axis for the head holder 5 is located to be higher than the second case 22. The head holder 5 moved upward is located to be higher than the opening 46 of the cartridge case 4. A tip end portion of the head holder 5 is located between the ribbon storages H1, H2 in the cartridge case 4. The thermal head 50 is located at a rearward position with respect to the base 51 of the head holder 5. A direction of the head holder 5 extending from the second axis X12 toward the thermal head 50 in the view from the right is a downward direction. The subsidiary arm 6 stays at the fifth position, in the same position as shown in FIG. 6. In conjunction with the motion of the head holder 5, the conveyer roller 51D in the head holder 5 contacts the second engageable portions 63 in the subsidiary arm 6. More specifically, the conveyer roller 51D in the head holder 5 engages with the second engageable portions 63 in the subsidiary arm 6. In this regard, contact between the conveyer roller 51D and the second engageable portions 63 includes engagement between the conveyer roller 51D and the second engageable portions 63. A minimum distance between the conveyer roller 51D and the cover 23, when the conveyer roller 51D in the head holder 5 contacts the second engageable portions 63 in the subsidiary arm 6 while the cover 23 is in transition to pivot from the first position to the second position, will be expressed as a first distance M11 (not shown).

As the cover 23 pivots further toward the second position (open position), the protrusive portions 51B (see FIG. 4) separate upward from the guides 31D in the ink ribbon supporting member 3. Meanwhile, the conveyer roller 51D in the head holder 5 and the second engageable portions 63 stay in contact with each other. More specifically, the engagement between the conveyer roller 51D in the head holder 5 and the second engageable portions 63 in the subsidiary arm 6 is maintained. In response to the pivoting motion of the cover 23, with the conveyer roller 51D being engaged with the second engageable portions 63, the subsidiary arm 6 pivots about the fifth axis X15. Moreover, when the subsidiary arm 6 extending from the fifth axis X15 toward the second engageable portions 63 is in a posture to incline rearward with respect to the vertical direction, the subsidiary arm 6 acts on the head holder 5 to apply a rearward force so that the thermal head 50 is pulled to be closer to the cover 23.

FIG. 8 shows the cover 23 moved to the second position (open position). The head holder 5 is located to be higher than the second case 22. The subsidiary arm 6 extending from the fifth axis X15 toward the second engageable portions 63 inclines upper-rearward with respect to the vertical direction. In the following paragraphs, the position of the subsidiary arm 6 in this posture as shown in FIG. 8 will be expressed as a sixth position. A direction of the head holder 5 extending from the second axis X12 toward the thermal head 50 inclines lower-frontward to a small extent with respect to the vertical direction in the view from the right. The heater surface of the thermal head 50 faces toward the cover 23. In the following paragraphs, the position of the head holder 5 in this posture shown in FIG. 8 will be expressed as a retracted position. A minimum distance between the cover 23 and the conveyer roller 51D while the head holder 5 is at the retracted position will be expressed as a second distance M12 (not shown). The second distance M12 is shorter than the first distance M11, which is the minimum distance between the conveyer roller 51D and the cover 23 when the conveyer roller 51D in the head holder 5 contacts the second engageable portions 63 in the subsidiary arm 6 while the cover 23 is in transition to pivot from the first position to the second position (see FIG. 7).

Meanwhile, a distance between the fifth axis X15 and the second engageable portions 63 in the subsidiary arm 6, and a distance between the fifth axis X15 and the second axis X12, while the subsidiary arm 6 is located at the sixth position, will be expressed as a third distance M23 and a fourth distance M24, respectively. The third distance M23 is shorter than the fourth distance M24.

The head holder 5 is located rearward with respect to a rearward end of the cartridge case 4. In particular, the head holder 5 is located to be closer to the first axis X11, which is the pivot axis for the cover 23, than an end of the cartridge case 4 closer to the first axis X11 in the front-rear direction, i.e., the rearward end. In other words, the head holder 5 is located between the first axis X11 and the rearward end of the cartridge case 4 in the front-rear direction. Therefore, when, for example, the user attempts to remove the cartridge case 4 from the ink ribbon supporting member 3 in order to store the ribbon rolls R1, R2 in the cartridge case 4 and moves the cartridge case 4 upward, the cartridge case 4 may not collide with the head holder 5. Moreover, while the heater surface of the thermal head 50 faces rearward toward the cover 23, an undesirable touch by the user to the thermal head 50 may be prevented when the user attempts to move the cartridge case 4 upward.

Closing Motion of Cover 23

With reference to FIGS. 9-12, described below will be behaviors of the movable items in the thermal-transfer printer 1A when the cover 23 moves from second position (open position) to the first position (closed position). The following description will be based on a condition where the second case 22 is maintained at the third position (closed position). The motions may occur, for example, once the cartridge case 4 with the ribbon rolls R1, R2 stored therein is attached to the ink ribbon supporting member 3, and when the user attempts to close the cover 23 in order to start printing an image in the thermal-transfer printer 1A. The user may draw the printing medium from the medium roll Q stored in the first case 21 and place the printing medium on the platen roller P before closing the cover 23.

FIG. 9 shows the cover 23 being at the second position (open position). The subsidiary arm 6 is located at the sixth position, where the second engageable portions 63 is engaged with the conveyer roller 51D in the head holder 5 being at the retracted position.

FIG. 10 shows a transient posture of the cover 23 being in transition to pivot from the second position (open position) (see FIG. 9) to the first position (closed position) (see FIG. 12). With the conveyer roller 51D being engaged with the second engageable portions 63, the cover 23 pivots, and in response to the pivoting motion of the cover 23, the subsidiary arm 6 pivots about the fifth axis X15. When the subsidiary arm 6 extending from the fifth axis X15 toward the second engageable portions 63 is in a posture to incline frontward with respect to the vertical direction, the subsidiary arm 6 acts on the head holder 5 to apply a frontward force so that the thermal head 50 is pushed to be farther from the cover 23. The protrusive portions 51B (see FIG. 4) in the head holder 5 are directed toward the upper end areas in the guides 31D in the ink ribbon supporting member 3.

FIG. 11 shows another transient posture of the cover 23 further pivoting from the position shown in FIG. 10 toward the first position (closed position) (see FIG. 12). The subsidiary arm 6 is located at the fifth position, at which the conveyer roller 51D is separated from the second engageable portions 63. The protrusive portions 51B (see FIG. 4) in the head holder 5 enter the guides 31D in the ink ribbon supporting member 3. The head holder 5 enters the intermediate area between the ribbon rolls R1, R2 stored in the cartridge case 4 and moves downward. While the head holder 5 extends downward from the second axis X12 toward the thermal head 50, the conveyer roller 51C in the head holder 5 contacts the ink ribbon R, which is extended between the ribbon rolls R1, R2, from the upper side. The head holder 5 passing through the intermediate area between ribbon rolls R1, R2 moves downward. While moving downward through the intermediate area between the ribbon rolls R1, R2, the head holder 5 does not contact the ribbon rolls R1, R2.

FIG. 12 shows the cover 23 being at the first position (closed position). The protrusive portions 51B (see FIG. 4) in the head holder 5 moved along the guides 31D in the ink ribbon supporting member 3 reach the lower ends in the guides 31D. The head holder 5 is located at the printable position. The heater surface of the thermal head 50 faces downward toward the platen roller P (see FIG. 2) at the upper position with respect to the platen roller P. In this arrangement, the ink ribbon R and the printing medium are interposed between the thermal head 50 and the platen roller P from the upper side and the lower side, respectively. The fitting portions 51E in the head holder 5 are placed to fit in the bearings, which are located at widthwise end areas in the platen roller P, from the upper side. Thus, the position of the thermal head 50 with respect to the platen roller P may be maintained.

In this arrangement, the printing medium and the ink ribbon R at the position between the platen roller P and the thermal head 50 may be conveyed frontward. The conveyer rollers 51C, 51D in the head holder 5 may rotate along with the conveyance of the ink ribbon R. As the thermal head 50 is heated, the ink on the ink ribbon R may be transferred onto the printing medium. Thus, an image may be printed on the printing medium.

Arrangement of First Axis X11 and Second Axis X12

With reference to FIG. 13, described below will be arrangement of the first axis X11 and the second axis X12 when the head holder 5 is located at the printable position. The following description will be based on a condition where the second case 22 is located at the third position (closed position), and the cover 23 is located at the first position (closed position).

In a condition where the cartridge case 4 with the ribbon rolls R1, R2 being stored therein is attached to the ink ribbon supporting member 3, a position where the axial center of the first spool R11 is located will be expressed as a first center C11, and a position where the axial center of the second spool R21 is located will be expressed as a second center C12. The first center C11 and the second center C12 extend linearly in the widthwise direction. The first center C11 and the second center C12 are apart from each other for the predetermined distance L in the front-rear direction. A maximum radius Rm for the ribbon roll R1 and for the ribbon roll R2 corresponds to a length between the first center C11 and the lower end of the cartridge case 4 and a length between the second center C12 and the lower end of the cartridge case 4, respectively. The maximum radius Rm is smaller than a half distance L/2, which is the predetermined distance L divided equally by 2.

A virtual plane containing the first center C11 and the second center C12 will be expressed as a plane S11. The plane S11 spreads horizontally to extend linearly in the front-rear direction in a view from the right or the left, i.e., in a view along the widthwise direction. A virtual plane, which is located to be lower than the plane S11 and apart from the plane S11 for the half distance L/2, will be expressed as a plane S12. The plane S12 is located to be lower than the lower end of the cartridge case 4. The plane S12 is located to be higher than an axial center P1 of the platen roller P and than an axial center Q1 of the medium roll Q, around which the printing medium is rolled. Another virtual plane, which is located to be higher than the plane S11 and apart from the plane S11 for the half distance L/2, will be expressed as a plane S13. The plane S13 is located to be substantially lower than an upper end of the second case 22. The position of the plane S12 will be expressed as a lower-end position Sp12, and the position of the plane S13 will be expressed as an upper-end position Sp13.

The first axis X11 is located within a first area T1. The first area T1 is located frontward, i.e., closer to the front side of the thermal-transfer printer 1A, with respect to the wall 22D at the rear end of the second case 22; rearward, i.e., closer to the rear side of the thermal-transfer printer 1A, with respect to the first center C11; lower than the wall 22E being the upper wall of the second case 22, more specifically, lower than the upper-end position Sp13; and higher than the lower-end position Sp12. With regard to FIG. 13, the first axis X11 is located within the first area T1, in proximity to a downward face of the wall 22E of the second case 22. More specifically, the first axis X11 is located within the first area T1, at a position higher than a center between the wall 22E of the second case 22 and the plane S11, and lower than the wall 22E.

The second axis X12 is located within a second area T2. The second T2 is located frontward, i.e., closer to the front side of the thermal-transfer printer 1A, with respect to the first center C11; rearward, i.e., closer to the rear side of the thermal-transfer printer 1A, with respect to the second center C12; lower than the wall 22E of the second case 22, more specifically, lower than the upper-end position Sp13; and higher than the lower-end position Sp12. Meanwhile, the second area T2 between the first center C11 and the second center C12 is trisected in the front-rear direction equally into three (3) divided areas T21, T22, T23 by virtual planes spreading, for example, orthogonally to the front-rear direction. The divided areas T21, T22, T23 are arranged at a frontward position, a central position, and at a rearward position, respectively, in the order given in the second area T2 along the front-rear direction. With regard to FIG. 13, the second axis X12 is located in the divided area T22 in midst between the divided area T21 and the divided area T23 in the front-rear direction.

Second Embodiment

A thermal-transfer printer 1B according to a second embodiment of the present disclosure will be described in the following paragraphs. In the following description, items or structures which are identical or equivalent to those described in the previous embodiment may be referred to by the same reference signs, and explanation of those will be omitted.

Case 2B

As shown in FIG. 14, the thermal-transfer printer 1B includes a case 2B, which has an approximate shape of a rectangular box. The case 2B includes a second case 24 in place of the second case 22 in the thermal-transfer printer 1A (see FIG. 1). The second case 24 is pivotably supported by the linkages 213 (see FIG. 2) on the first case 21 to pivot about a third axis X23, which extends in the widthwise direction. The second case 24 may pivot to open and close the opening 211 (see FIG. 2) of the first case 21. The second case 24 may be located the same positions as the second case 22, including the third position (closed position) and the fourth position (open position), and the directions related to the second case 24 will be based on those of the second case 24 being at the third position (closed position) as shown in FIG. 14 and as indicated by the arrows in FIG. 14.

The second case 24 includes walls 24A, 24B, 24C, 24D, 24E, which serve as parts of a front wall, a right-side wall, a left-side wall, a rear wall, and an upper wall, respectively, of the second case 24. Lower ends of the walls 24A-24D form an opening 241 at a lower end of the second case 24. Unlike the second case 22 in the first embodiment, no recess is formed in the wall 24A or 24E, in other words, the second case 24 does not have an opening at an upper position therein. On a frontward face of the wall 24A, arranged is a handle 242 protruding frontward.

When the second case 24 is at the third position (closed position) to cover the opening 211 of the first case 21, the opening 211 at the upper end of the first case 21 and the opening 241 at the lower end of the second case 24 are connected to be at least partly continuous with each other.

When the second case 24 is at the third position (closed position), a frontward face of the wall 21A, the rightward face of the wall 21B, the leftward face of the wall 21C, the rearward face of the wall 21D align flat on same vertical planes with a frontward of the wall 24A, a rightward face of the wall 24B, a leftward face of the wall 24C, and a rearward face of the wall 24D, respectively without forming different-leveled tiers so that at joints between the walls 21A and 24A, between the walls 21B and 24B, between the walls 21C and 24C, and between the walls 21D and 24D, no substantial difference in depth or width is caused.

An ink ribbon supporting member 7 (see FIG. 15), in place of the ink ribbon supporting member 3 (see FIG. 5) in the first embodiment, is pivotably supported by the linkages 213 (see FIG. 1) on the first case 21. The cartridge case 4, as described in the first embodiment, is attachable to the ink ribbon supporting member 7. The second case 24 may store the ink ribbon supporting member 7 and the cartridge case 4 therein.

Ink Ribbon Supporting Member 7

As shown in FIG. 15, to the ink ribbon supporting member 7, the cartridge case 4 supporting the ribbon rolls R1, R2 (see FIG. 5) therein is attachable from the upper side. FIG. 15 shows appearance of the ink ribbon supporting member 7 when the ink ribbon supporting member 7 is stored in the second case 24. The ink ribbon supporting member 7 is attached to an interior of the second case 24. In the following paragraphs, unless otherwise noted, directions related to the ink ribbon supporting member 7 will be based the on those of the ink ribbon supporting member 7 and as indicated by the arrows in FIG. 15. A part of the ink ribbon supporting member 7 in a rearward area is located to be higher than the medium storage 212 (see FIG. 2) in the first case 21.

As shown in FIG. 16, the ink ribbon supporting member 7 has two (2) sidewalls 71 and a bridged portion 72. The sidewalls 71 correspond to the sidewalls 31 (see FIG. 5) in the ink ribbon supporting member 3 in the first embodiment. A distance between the sidewalls 71 is substantially equal to a distance between the walls 24B, 24C of the second case 24 (see FIG. 14). The sidewalls 71 on the right and the left are located in proximity to inner surfaces of the wall 24B and the wall 24C, respectively. The bridged portion 72 corresponds to the bridged portion 32 (see FIG. 5).

Each sidewall 71 has an extended portion 71A, which extends rearward at a rearward area in the sidewall 71. An end of the extended portion 71A is connectable to the linkage 213 (see FIG. 2) in the first case 21 pivotably to pivot about a fourth axis X24, which extends in the widthwise direction. A position of the fourth axis X24 is different from a position of a third axis X23 (see FIG. 14), which is a pivot axis for the second case 24 pivotably supported by the linkages 213. Protrusive portions 71B and protrusive portions 71C on the upper edges of the sidewalls 71 correspond to the protrusive portions 31B and the protrusive portions 31C (see FIG. 5) on the ink ribbon supporting member 3 in the first embodiment. When the cartridge case 4 is attached to the ink ribbon supporting member 7 from the upper side, the protrusive portions 71B on the ink ribbon supporting member 7 fit in the holes 41A in the cartridge case 4 (see FIG. 3). The extended portions 41 in the cartridge case 4 are flanked sideward by the protrusive portions 71C in the ink ribbon supporting member 7 from the outer sides in the widthwise direction.

Guides 71D arranged on inner faces of the sidewalls 71 correspond to the guides 31D (see FIG. 5) in the ink ribbon supporting member 3 in the first embodiment. Each guide 71D is engageable with one of the protrusive portions 51B in the head holder 5, as will be described further below.

Each sidewall 71 has protrusive portions 711, 712, which protrude inward from an inner face of the sidewall 71, at rearward positions with respect to a center of the ink ribbon supporting member 7 in the front-rear direction. The protrusive portions 711, 712 each has a cylindrical shape. The protrusive portions 711, 712 align in the vertical direction, and the protrusive portion 711 is located to be lower than the protrusive portion 712. The protrusive portions 711 may pivotably support a subsidiary arm 8, as will be described further below. The protrusive portions 712 may pivotably support a head arm 9, as will be described further below.

Head Arm 9

As shown in FIG. 16, the head arm 9 includes two (2) bases 91, a bridged portion 92, and a linkage 93. The bases 91 each has an approximate shape of a bar and are located to be spaced apart from each other in the widthwise direction. A distance between the bases 91 is substantially equal to a distance between the sidewalls 71 in the ink ribbon supporting member 7. The bridged portion 92 has an approximate shape of a plate and is extended between frontward portions of the bases 91.

The head arm 9 is pivotably supported by the protrusive portions 712 in the ink ribbon supporting member 7. FIGS. 15 and 16 show the head arm 9 at a farthest counterclockwise-pivoted position for the head arm 9 in a view from the right. In this position shown in FIGS. 15 and 16, the bases 91 in the head arm 9 extend horizontally. In the following paragraphs, unless otherwise noted, directions related to the head arm 9 will be based on the posture of the head arm 9 at the farthest counterclockwise-pivoted position as shown in FIGS. 15, 16 and as indicated by the arrows in FIGS. 15 and 16. Meanwhile, pivotable directions, e.g., clockwise and counterclockwise, concerning each item in the following description will be based on a sideward view from the right.

Each of the bases 91 has a hole 911 in a form of a slit on an upper end position therein. The hole 911 is formed to longitudinally extend in the front-rear direction. Each base 91 has extended portions 94, 95 at a rearward end position therein. The extended portion 94 extends lower-rearward at the rearward area in the base 91. At a rearward end in the extended portion 94, formed through in the widthwise direction is a hole 941. The extended portion 95 extends rearward at a rearward area in the extended portion 94. On an outer face of each extended portion 94, arranged is a protrusive portion 951 protruding outward in the widthwise direction.

The protrusive portions 712 on the ink ribbon supporting member 7 are inserted in the holes 941 in the head arm 9 inward in the widthwise direction from the widthwise outer side.

The head arm 9 is pivotably supported by the ink ribbon supporting member 7 to pivot about a first axis X21, which extends through the holes 941 and the protrusive portions 712 in the widthwise direction. In the following paragraphs, the position of the head arm 9 at the farthest counterclockwise-pivoted position pivoted about the first axis X21, as shown in FIGS. 15 and 17, will be expressed as a first position. As shown in FIGS. 15 and 17, when the head arm 9 is located at the first position, the bases 91 contact the extended portions 41 in the cartridge case 4 attached to the ink ribbon supporting member 7 from the upper side. Meanwhile, as shown in FIG. 15, the bridged portion 92 covers a rearward area with respect to a center in the front-rear direction in the cartridge case 4 from the upper side. In this regard, when the cartridge case 4 holds the ribbon rolls R1, R2 therein, an upper side of the ribbon roll R1 may be covered by the bridged portion 92. The head arm 9 at the first position may be closer to the first case 21 (see FIG. 14) than the head arm 9 being in the other positions.

The head arm 9 is pivotable clockwise from the first position to pivot about the first axis X21, as shown in FIGS. 18-20. FIG. 20 shows the head arm 9 at a farthest clockwise-pivoted position pivoted clockwise about the first axis X21. In the following paragraphs, the position of the head arm 9 at the farthest clockwise-pivoted position pivoted about the first axis X21, as shown in FIG. 20, will be expressed as a second position. The second position for the head arm 9 is higher than the first position. When the head arm 9 is located at the second position, the bases 91 extend upper-rearward. The head arm 9 in the second position is separated farther from the first case 21 than the head arm 9 in the first position.

As shown in FIG. 16, on a lower face of the bridged portion 92, arranged is a linkage 93. The linkage 93 includes two (2) side plates 93A and a bridged portion 93B. The side plates 93A are spaced apart from each other in the widthwise direction and spread orthogonally to the widthwise direction. At a lower end of each side plate 93A, bored through in the widthwise direction is a hole 932. The bridged portion 93B having an approximate shape of a plate is extended between the side plates 93A. On a frontward face of the bridged portion 93B, arranged is a knob 931. The knob 931 has an approximate shape of a plate extended frontward. A user may hold the knob 931 by hand in order to pivot the head arm 9 clockwise or counterclockwise with respect to the ink ribbon supporting member 7.

The head holder 5, which may be identical with the head holder 5 described in the first embodiment, is attached to a tip end of the linkage 93. The protrusive portions 51A on the sidewalls 511 in the head holder 5 are inserted outward in the widthwise direction into the holes 932 formed in the side plates 93A in the linkage 93. The head holder 5 is pivotably supported by the head arm 9 to pivot about a second axis X22, which extends through the holes 932 in the side plates 93A in the widthwise direction.

Subsidiary Arm 8

The subsidiary arm 8 is pivotably held by the ink ribbon supporting member 7. The subsidiary arm 8 may pivot in response to a pivoting motion of the head arm 9. FIG. 16 shows the subsidiary arm 8 when the head arm 9 is located at the first position. In the following paragraphs, unless otherwise noted, directions related to the subsidiary arm 8 will be based on a posture of the subsidiary arm 8 when the head arm 9 is at the first position, as shown in FIG. 16 and as indicated by the arrows in FIG. 16.

As shown in FIG. 16, the subsidiary arm 8 has two (2) extended portions 81 and a bridged portion 82. Each extended portion 81 has a first portion 81A, a second portion 81B, and a third portion 81C. The first portion 81A extends horizontally in the front-rear direction. The second portion 81B extends downward from a rearward end of the first portion 81A. The third portion 81C extends lower-rearward from a rearward end of the second portion 81B. The bridged portion 82 has an approximate shape of a plate and extends between the first portions 81A in the extended portions 81.

Each first portion 81A in the extended portion 81 has a second engageable portion 83, which has an approximate shape of a plate, having a recessed portion 83A. The recessed portion 83A is formed to recess rearward from a frontward end of the second engageable portion 83. The second engageable portions 83 are engageable with the conveyer roller 51D (see FIG. 4) in the head holder 5. In the third portion 81C in each extended portion 81, formed through in the widthwise direction is a hole 84. The protrusive portions 711 in the ink ribbon supporting member 7 are inserted inward in the widthwise direction in the holes 84 from the widthwise outer side. The subsidiary arm 8 is pivotably supported by the ink ribbon supporting member 7 to pivot about a fifth axis X25, which extends in the widthwise direction, at the rearward areas in the extended portions 81. At a rearward end positions in each third portion 81C in the extended portion 81, arranged is a third engageable portion 85, in which a recessed portion 85A is formed. The third engageable portion 85 is engageable with the protrusive portion 951 in the head arm 9.

Opening and Closing Motions of Head Arm 9

With reference to FIGS. 17-20, described below will be behaviors of the movable items in the thermal-transfer printer 1B when the head arm 9 moves between the first position (see FIG. 17) and the second position (see FIG. 20). The following description will be based on a condition where the second case 24 is maintained at the third position (closed position), and the ribbon rolls R1, R2 are not stored in the cartridge case 4. The motions may occur when, for example, when the user moves the second case 24 (see FIG. 14) to the fourth position (open position) to operate the head arm 9 in order to take out the cartridge case 4 and store the ribbon rolls R1, R2 in the cartridge case 4, and the user operates the knob 931 on the head arm 9 to move the head arm 9 from the first position to the second position.

FIG. 17 shows the head arm 9 located at the first position. The linkage 93 extending downward in the head arm 9 is located between the ribbon storages H1, H2 in the cartridge case 4. The protrusive portions MB (see FIG. 16) in the head holder 5 are located at lower ends of the guides 71D in the ink ribbon supporting member 7. The head holder 5 is located at the printable position. The second axis X22 being the pivot axis for the head holder 5 is located between the ribbon storages H1, H2. A direction of the head holder 5 extending from the second axis X22 toward the thermal head 50 inclines with respect to the vertical direction, in the view from the right, lower-frontward.

The first portions 81A in the subsidiary arm 8 contact the upper ends of the extended portions 41 in the cartridge case 4 and extend in the horizontal direction. The subsidiary arm 8 is restricted from pivoting counterclockwise by the cartridge case 4 contacting the first portions 81A. In other words, the cartridge case 4 may restrict the subsidiary arm 8 at the fifth position from pivoting in a direction opposite to the second direction, i.e., counterclockwise, by the contact with the first portions 81A. A part of each second engageable portion 83 in the subsidiary arm 8 enters the hole 911 in the head arm 9 from the lower side to protrude to be partly higher than the base 91 in the head arm 9. In the following paragraphs, unless otherwise noted, the position of the subsidiary arm 8 in this posture will be expressed as a fifth position, which corresponds to a condition of the subsidiary arm 8 at the farthest counterclockwise-pivoted position. When the subsidiary arm 8 is at the fifth position, the second engageable portions 83 are separated from the conveyer roller 51D.

FIG. 18 shows a transient posture of the head arm 9 being in transition to pivot from the first position toward the second position. The protrusive portions 51B (see FIG. 16) in the head holder 5 moved along the guides 71D in the ink ribbon supporting member 7 reach the upper end areas in the guides 71D. The linkage 93 in the head arm 9 moved upward is located to be higher than the ink ribbon supporting member 7, and the second axis X22 being the pivot axis for the head holder 5 is located to be higher than the ink ribbon supporting member 7. The head holder 5 moved upward is located to be higher than the opening 46 (see FIG. 3) of the cartridge case 4. The tip end portion of the head holder 5 is located between the ribbon storages H1, H2 in the cartridge case 4. The thermal head 50 is located at a rearward position with respect to the base 51 of the head holder 5. A direction of the head holder 5 extending from the second axis X22 toward the thermal head 50 in the view from the right is a downward direction. The subsidiary arm 8 stays at the fifth position, in the same position as shown in FIG. 17. In conjunction with the motion of the head holder 5, the conveyer roller 51D in the head holder 5 contacts the second engageable portions 83 in the subsidiary arm 8, and the protrusive portions 951 in the head arm 9 are engaged with the third engageable portions 85 from the rear side. A minimum distance between the conveyer roller 51D and the second engageable portions 83 in the subsidiary arm 8, when the conveyer roller 51D in the head holder 5 contacts the second engageable portions 83 in the subsidiary arm 8 while the head arm 9 is in transition to pivot from the first position to the second position, will be expressed as a first distance M21 (not shown).

FIG. 19 shows the head arm 9 pivoted further toward the second position from the position shown in FIG. 18. The protrusive portions 51B (see FIG. 16) separate upward from the guides 71D in the ink ribbon supporting member 7. Meanwhile, the engagement between the protrusive portions 951 in the head arm 9 and the third engageable portions 85 in the subsidiary arm 8 is maintained. In response to the pivoting motion of the head arm 9, with the protrusive portions 951 being engaged with the third engageable portions 85, the subsidiary arm 8 pivots about the fifth axis X25. Meanwhile, the contact between the conveyer roller 51D in the head holder 5 and the second engageable portions 83 in the subsidiary arm 8 is maintained.

As the head arm 9 pivots further toward the second position, the second engageable portions 83 in the subsidiary arm 8 are engaged with the conveyer roller 51D in the head holder 5. The subsidiary arm 8 may pivot to accompany with the pivoting motion of the head arm 9 and may act on the head holder 5 to apply a rearward force so that the thermal head 50 is pulled to be closer to the head arm 9.

FIG. 20 shows the head arm 9 moved to the second position. The head holder 5 is located to be higher than the second case 24. The first part 81A in the subsidiary arm 8 extends vertically. In the following paragraphs, the position of the subsidiary arm 8 in this posture as shown in FIG. 20 will be expressed as a sixth position. A direction of the head holder 5 extending from the second axis X22 toward the thermal head 50 inclines lower-frontward to a small extent with respect to the vertical direction. The head holder 5 is located at the retracted position, and the heater surface of the thermal head 50 faces toward the head arm 9. A minimum distance between the head arm 9 and the conveyer roller 51D while the head holder 5 is at the retracted position will be expressed as a second distance M22 (not shown). The second distance M22 is shorter than the first distance M21, which is the minimum distance between the conveyer roller 51D and the second engageable portions 83 when the conveyer roller 51D in the head holder 5 contacts the second engageable portions 83 in the subsidiary arm 8 as the head arm 9 pivots from the first position to the second position.

Meanwhile, a distance between the fifth axis X25 and the second engageable portions 83 in the subsidiary arm 8, and a distance between the fifth axis X25 and the second axis X22, while the subsidiary arm 8 is located at the sixth position, will be expressed as a third distance M23 (not shown) and a fourth distance M24 (not shown), respectively. The third distance M23 is shorter than the fourth distance M24.

The head holder 5 is located rearward with respect to a rearward end of the cartridge case 4. In particular, the head holder 5 is located to be closer to the first axis X21, which is the pivot axis for the head arm 9, than an end of the cartridge case 4 that is closer to the first axis X21, in the front-rear direction. In other words, the head holder 5 is located between the first axis X21 and the rearward end of the cartridge case 4. Therefore, when, for example, the user attempts to remove the cartridge case 4 from the ink ribbon supporting member 7 and moves the cartridge case 4 upward, the cartridge case 4 may not collide with the head holder 5. Moreover, while the heater surface of the thermal head 50 faces toward the head arm 9, an undesirable touch by the user to the thermal head 50 may be prevented when the user attempts to move the cartridge case 4 upward.

The head arm 9 may move from the second position (see FIG. 20) to the first position (see FIG. 17). For example, when the thermal-transfer printer 1B is in the condition shown in FIG. 20, the user may attach the cartridge case 4 with the ribbon rolls R1, R2 stored therein to the ink ribbon supporting member 7 and operate the knob 931 in the head arm 9 to move the head arm 9 from the second position to the first position before starting printing an image in the thermal-transfer printer 1A.

While the protrusive portions 951 are engaged with the third engageable portions 85 in the subsidiary arm 8, as shown in FIG. 19, the head arm 9 pivots from the second position toward the first position. Therefore, the subsidiary arm 8 subjected to the force from the head arm 9 through the third engageable portions 85 pivots about the fifth axis X25 from the sixth position (see FIG. 20) toward the fifth position (see FIG. 17). Meanwhile, the second engageable portions 83 in the subsidiary arm 8 are engaged with the conveyer roller 51D in the head holder 5. Therefore, the subsidiary arm 8 may act on the head holder 5 to apply a frontward force so that the thermal head 50 is pushed to be farther from the head arm 9. The protrusive portions 51B (see FIG. 16) in the head holder 5 are directed toward the upper end areas in the guides 71D in the ink ribbon supporting member 7.

As shown in FIG. 18, the subsidiary arm 8 is moved by the pivoting motion of the head arm 9 to the fifth position while the conveyer roller 51D is separated from the second engageable portions 83. The protrusive portions 51B (see FIG. 16) in the head holder 5 moved to be higher than the upper edges of the guides 71D in the ink ribbon supporting member 7 enter the guides 71D. The head holder 5 entering between the ribbon rolls R1, R2 stored in the cartridge case 4 moves downward. While the direction of the head holder 5 extending from the second axis X22 toward the thermal head 50 is a downward direction, the conveyer roller 51C in the head holder 5 contacts the ink ribbon R, which is extended between the ribbon rolls R1, R2, from the upper side. The head holder 5 passing through the area between ribbon rolls R1, R2 moves downward.

As shown in FIG. 17, when the head arm 9 moves to the first position, the protrusive portions 51B (see FIG. 16) in the head holder 5 move along the guides 71D in the ink ribbon supporting member 3 to reach the lower end areas in the guides 71D. The head holder 5 is located at the printable position. The heater surface of the thermal head 50 faces downward toward the platen roller P (see FIG. 2) at the position higher than the platen roller P. In this arrangement, the ink ribbon R and the printing medium are interposed between the thermal head 50 and the platen roller P from the upper side and the lower side, respectively. As the thermal head 50 is heated, the ink on the ink ribbon R may be transferred onto the printing medium. Thus, an image may be printed on the printing medium.

Arrangement of the First Axis X11 and the Second Axis X12

With reference to FIG. 21, described below will be arrangement of the first axis X21 and the second axis X22 when the head holder 5 is located at the printable position. The following description will be based on a condition where the second case 24 is located at the third position (closed position), and the head arm 9 is located at the first position. In a condition where the cartridge case 4 with the ribbon rolls R1, R2 stored therein is attached to the ink ribbon supporting member 7, a position where a center of the first spool R11 is located will be expressed as a first center C21, and a position where a center of the second spool R21 is located will be expressed as a second center C22. The first center C21 and the second center C22 extend linearly in parallel with the widthwise direction. The first center C11 and the second center C12 are apart from each other for a predetermined distance L in the front-rear direction.

A virtual plane containing the first center C21 and the second center C22 will be expressed as a plane S21. The plane S21 spreads horizontally and extends linearly in the front-rear direction in a view from the right or the left, i.e., in a view along the widthwise direction. A virtual plane, which is located to be lower than the plane S21 and apart from the plane S21 for a half distance L/2 being a half of the predetermined distance L, will be expressed as a plane S22. Another virtual plane, which is located to be higher than the plane S21 and apart from the plane S21 for the half distance L/2, will be expressed as a plane S23. The plane S23 is located to be slightly lower than an upper end of the second case 24. The position of the plane S22 will be expressed as a lower-end position Sp22, and the position of the plane S23 will be expressed as an upper-end position Sp23.

The first axis X21 is located within a first area T3. The first area T3 is located frontward, i.e., closer to the front side of the thermal-transfer printer 1B, with respect to the wall 24D at the rear end of the second case 24; rearward, i.e., closer to the rear side of the thermal-transfer printer 1B, with respect to the first center C21; lower than the upper wall 24E of the second case 24, more specifically, lower than the upper-end position Sp23; and higher than the lower-end position Sp22. With regard to FIG. 21, the first axis X21 is located within the first area T3, in proximity to the plane S21. More specifically, the first axis X21 is located within the first area T3, at a position lower than a center between the plane S21 and the plane S23, and higher than a center between the plane S21 and the plane S22.

The second axis X22 is located within a second area T4. The second T4 is located frontward, i.e., closer to the front side of the thermal-transfer printer 1B, with respect to the first center C21; rearward, i.e., closer to the rear side of the thermal-transfer printer 1B, with respect to the second center C22; lower than the upper wall 24E of the second case 24, more specifically, lower than the upper-end position Sp23; and higher than the lower-end position Sp22. Meanwhile, the second area T4 between the first center C21 and the second center C22 in the front-rear direction is trisected equally into three (3) divided areas T41, T42, T43 by virtual planes spreading, for example, orthogonally to the front-rear direction. The divided areas T41, T42, T43 are arranged at a frontward position, a central position, and at a rearward position, respectively, in the order given in the second area T4 along the front-rear direction. With regard to FIG. 21, the second axis X22 is located in the divided area T42 in midst between the divided area T41 and the divided area T43 in the front-rear direction.

Third Embodiment

A thermal-transfer printer 1C according to a third embodiment of the present disclosure will be described in the following paragraphs. The thermal-transfer printer 1C includes a case 2C, which is in a different shape from the case 2A (see FIG. 1) in the thermal-transfer printer 1A in the first embodiment. The thermal-transfer printer 1C has the head holder 5, the ink ribbon supporting member 3, and the subsidiary arm 6, which are in the same configurations as those in the thermal-transfer printer 1A in the first embodiment. In the following description, items or structures which are identical or equivalent to those described in the previous embodiment may be referred to by the same reference signs, and explanation of those will be omitted.

Case 2C

As shown in FIG. 22, the thermal-transfer printer 1C includes the case 2C, which is in an approximate shape of a rectangular box. The case 2C includes a first case 26, a second case 27, and a cover 28, which partly form exterior faces of the thermal-transfer printer 1C. As shown in FIG. 23, the first case 26 includes walls 26A, 26B, 26C, 26D, 26E, and an opening 261, which correspond to the walls 21A, 21B, 21C, 21D, 21E, and the opening 211 in the case 2A (see FIG. 2) in the first embodiment. The first case 26 has a medium storage 262, in which the medium roll Q may be rotatably supported, inside. The case 2C is different from the case 2A (see FIG. 1) in forms of areas where the walls 26A-26E adjoin one another. In other words, corners in the first case 26 are rounded.

As shown in FIGS. 22 and 23, on the wall 23B in the case 2C, arranged is a lever 263, which is vertically movable. As shown in FIG. 23, in an area in proximity to each widthwise end of the wall 26A inside the case 2C, arranged is an engageable part 265 having a shape of a claw. The engageable part 265 may pivot so that an upper end thereof moves rearward in response to an operation to move the lever 263 downward. The engageable part 265 is engageable with an engagement portion (not shown) arranged on the second case 27.

The second case 27 is located at a position higher than the first case 26. The second case 27 is pivotably supported by the first case 26 at a rearward end portion thereof to pivot about a third axis X33, which extends in the widthwise direction. When the second case 27 is at a third position (closed position) (see FIG. 23), the second case 27 covers the opening 261 of the first case 26 from the upper side, and when the second case 27 is at a fourth position (open position) (see FIG. 22), the second case 27 uncovers the opening 261 of the first case 26. In the following paragraphs, unless otherwise noted, directions related to the second case 27 will be based on the posture of the second case 27 being at the third position (closed position), as shown in FIG. 22 and as indicated by the arrows in FIG. 22.

As shown in FIG. 22, the second case 27 includes walls 27A, 27B, 27C, 27D, 27E, which serve as parts of a front wall, a right-side wall, a left-side wall, a rear wall, and an upper wall, respectively, of the second case 27. The wall 27E is connected with upper ends of the walls 27B, 27C, at rearward portions with respect to the front-rear direction, and with an upper end of the wall 27D. Areas where the walls 27A-27E adjoin one another, in other words, corners in the second case 27, are rounded. Lower ends of the walls 27A-27D form an opening 271 (see FIG. 23) at a lower end of the second case 27. As shown in FIG. 24, an upper end of the wall 27A, a part of an upper end of the wall 27B, a part of an upper end of the wall 27C, and a frontward end of the wall 27E form an opening 272 of the second case 27. The opening 272 is located at an upper position while the second case 27 is at the third position (closed position). When the second case 27 is at the third position (closed position) to cover the opening 211 of the first case 21, the opening 211 at the upper end of the first case 21 and the opening 271 at the lower end of the second case 27 are connected to be at least partly continuous with each other.

Inside the case 2C, in proximity to each widthwise end of the wall 27A, arranged is the engagement portion (not shown), which is engageable with the engageable portion 265 (see FIG. 23) in the second case 27. With the engagement portions being engaged with the engageable portions 265, the second case 27 is maintained at the third position (closed position) and restrained from pivoting toward the fourth position (open position) (see FIG. 23). When the lever 263 on the first case 26 is moved downward, the engageable parts 265 may be released from the engagement portions so that the second case 27 may pivot from the third position (closed position) toward the fourth position (open position). Therefore, the user may move the lever 263 so that the second case 27 may move to the fourth position (open position) and expose the opening 261, and the user may set the medium roll Q in the medium storage 262 inside the first case 26.

As shown in FIGS. 22 and 24, a recess formed on an upper end of the wall 27A in the first case 26 and a recess formed on a lower end of the wall 27A in the second wall 27 together form an ejector opening 266. The printing medium, on which an image is printed in the thermal-transfer printer 1C, may be ejected outward through the ejector opening 266.

As shown in FIGS. 22 and 24, the cover 28 may open or close the opening 272 (see FIG. 24) of the second case 27. The cover 28 has a shape identical with the outline of the opening 272 and is curved downward at a frontend portion and widthwise portions. The cover 28 is movably supported by the second case 27 to pivot with respect to the second case 27 about a first axis X31, which extends in the widthwise direction through a rearward area with respect to the opening 272. The first axis X31 is located at a frontward position with respect to a third axis X33, which is the pivot axis for the second case 27. The position of the cover 28 covering the opening 272 (see FIG. 22) corresponds to the first position (closed position), and the position of the cover 28 uncovering the opening 272 corresponds to a second position (opening). The first axis X31 extends the rearward end area of the cover 28 being at the first position (closed position). In the following paragraphs, unless otherwise noted, directions related to the cover 28 will be based on the posture of the cover 28 being at the first position (closed position) while the second case 27 is at the third position (closed position), as shown in FIG. 22 and as indicated by the arrows in FIG. 22.

As shown in FIG. 22, the cover 28 has a locking part 281 at a frontward end area thereof. The locking part 281 is pivotably supported by the cover 28 at a rearward end portion thereof. The locking part 281 may, while the cover 28 is located at the first position (closed position), pivot counterclockwise to be engaged with the upper end portion of the wall 27A in the second case 27. Thereby, the cover 28 may be maintained at the first position (closed position) and restrained from pivoting toward the second position (open position). The locking part 281 may pivot clockwise to be disengaged from the wall 27A. While the cover 28 is at the second position (open position), the cartridge case 4 may be exposed through the opening 272. Therefore, for example, the user may move the locking part 281 to pivot clockwise to move the cover 28 from the first position (closed position) to the second position (open position) so that the user may remove the cartridge case 4 from the ink ribbon supporting member 3.

As shown in FIG. 24, on a lower face, i.e., an inner face, of the cover 28, arranged is a linkage 283, which protrudes downward from the lower face of the cover 28. The head holder 5 is pivotably supported by a tip end of the linkage 283. A second axis X32 being a pivot axis for the head holder 5 corresponds to the second axis X12 (see FIG. 3) in the first embodiment described above. As shown in FIG. 25, the second case 27 may store the ink ribbon supporting member 3 and the cartridge case 4 being attached to the ink ribbon supporting member 3 therein. Unlike the first embodiment, the ink ribbon supporting member 3 in the third embodiment is supported by extended portions 31A, which extend from the sidewalls 31, pivotably with respect to the second case 27. A fourth axis X34 being a pivot axis for the ink ribbon supporting member 3 and a fifth axis X35 being a pivot axis for the subsidiary arm 6 correspond to the fourth axis X14 and the fifth axis X15 (see FIG. 5), respectively, in the first embodiment.

Benefits by the Embodiments

The thermal-transfer printers 1A, 1B, 1C have the ink ribbon supporting members 3, 7, 3, to which the cartridge cases 4, 4, 4 containing the ribbon rolls R1, R2 are attachable from the upper side, respectively. Therefore, the user may expose the area above the ink ribbon supporting members 3, 7, 3 widely while the cover 23, 28, or the head arm 9 is located at the second position. Through this open area, the user may attach the cartridge cases 4, 4, 4 to the ink ribbon supporting members 3, 7, 3 from the upper side. Therefore, the user may exchange the ink ribbons R, R, R to be used in the thermal-transfer printers 1A, 1B, 1C easily.

The thermal-transfer printers 1A, 1B, 1C may, as the cover 23, 28, and the head arm 9 moves from the second position to the first position, respectively, cause the ink ribbon R, which extends between the first spool R11 and the second spool R21, to contact a part of the head holder 5. With the ink ribbon R contacting the head holder 5, the thermal-transfer printers 1A, 1B, 1C each may place the ink ribbon R and the printing medium to be interposed between the thermal head 50 and the platen roller P and may heat the thermal head 50 so that the ink on the ink ribbon R may be transferred onto the printing medium by the heat. Thus, the thermal-transfer printers 1A, 1B, 1C may print images on the printing medium.

The thermal-transfer printer 1A defines the position of the first axis X11, which is the pivot axis for the cover 23, to be within the first area T1, and the position of the second axis X12, which is the pivot axis for the head holder 5, to be within the second area T2. Meanwhile, a circle centering about the first axis X11 and having a radius equal to a distance between the first axis X11 and the second axis X12 will be expressed as a pathway circle (not shown). In this regard, in the thermal-transfer printer 1A, a direction of a tangent at a point where the pathway circle intersects with the plane S11 tends to orient downward. Similarly, the thermal-transfer printer 1B defines the position of the first axis X21, which is the pivot axis for the head arm 9, to be within the first area T3, and the position of the second axis X22, which is the pivot axis for the head holder 5, to be within the second area T4. A pathway circle centers about the first axis X21 and has a radius equal to the distance between the first axis X21 and the second axis X22. In the thermal-transfer printer 1B, a direction of a tangent at a point where the pathway circle intersects with the plane S21 tends to orient downward. In this regard, a distance in the front-rear direction of a passage range between the ribbon rolls R1, R2, through which the head holder 5 may pass, may be restrained from increasing. Therefore, according to the thermal-transfer printers 1A, 1B, while the cover 23 and the head arm 9 move from the second position to the first position, the head holder 5 may be restrained from contacting the ribbon rolls R1, R2. Moreover, the first areas T1, T3, and the second areas T2, T4 are located in proximities to the ribbon rolls R1, R2. Therefore, the head holder 5 may be restrained from contacting the ribbon rolls R1, R2 while sizes of the cover 2 and the head arm 9 may be restrained from increasing.

The upper end of the first area T1, which defines the position of the first axis X11, and the upper end of the second area T2, which defines the position of the second axis X12, are defined by the upper-end position Sp13, which is apart upward for the half distance L/2 from the first center C11 and the second center C12, respectively. In this regard, in the thermal-transfer printer 1A, the movable pathway for the head holder 5 to pass through the range between the ribbon rolls R1, R2 as the cover 23 moves from the second position to the first position tends to orient downward. Similarly, the upper end of the first area T3, which defines the position of the first axis X21, and the upper end of the second area T4, which defines the position of the second axis X22, are defined by the upper-end position Sp23, which is apart upward for the half distance L/2 from the first center C21 and the second center C22, respectively. In this regard, in the thermal-transfer printer 1B, the movable pathway for the head holder 5 to pass through the range between the ribbon rolls R1, R2 as the head arm 9 moves from the second position to the first position tends to orient downward. Therefore, a distance in the range between the ribbon rolls R1, R2, through which the head holder 5 may pass, may be reduced. Thus, the thermal-transfer printers 1A, 1B, 1C may restrain the head holder 5 from contacting the ribbon rolls R1, R2 effectively.

In the second embodiment, the first axis X21 is located in proximity to the plane S21 within the first area T3. Therefore, in the thermal-transfer printer 1B, the movable direction for the head holder 5 passing through the range between the ribbon rolls R1, R2 may orient downward more acutely compared to the first embodiment. Thus, the thermal-transfer printer 1B may restrain the head holder 5 from contacting the ribbon rolls R1, R2 more effectively.

The second axis X12 is located within the divided area T22 in the midst in the front-rear direction among the divided areas T21, T22, T23, which are divided equally into three areas between the first center C11 and the second center C12. Similarly, the second axis X22 is located within the divided area T42 in the midst in the front-rear direction among the divided areas T41, T42, T43, which are divided equally into three areas between the first center C21 and the second center C22. In this regard, the head holder 5 may move through a position apart from both the ribbon roll R1 and the ribbon roll R2. Therefore, the thermal-transfer printers 1A, 1B may restrain the head holder 5 from contacting the ribbon rolls R1, R2 more effectively.

As the cover 23 and the head arm 9 move from the second position toward the first position, when the head holder 5 contacts the ink ribbon R from the upper side, the line extending through the head holder 5 from the second axis X12 to the thermal head 50 is oriented downward. In this regard, a distance in the front-rear direction in an area, in which the head holder 5 occupies, at the time when the head holder 5 contacts the ink ribbon R, may be reduced. Therefore, the thermal-transfer printers 1A, 1B, 1C may restrain the head holder 5 from contacting the ribbon rolls R1, R2 effectively regardless of the diameters of the ribbon rolls R1, R2.

The rear end of the first area T1, which defines the position of the first axis X11, is defined by the rearward wall 22D of the second case 22. The upper end of the first area T1 and the upper end of the second area T2 are defined by the upper wall 22E of the second case 22. In this regard, the thermal-transfer printer 1A may have the areas, in which the first axis X11 and the second axis X12 are located, to stay within the case 2A. Moreover, the position of the first axis X11 may be arranged in proximity to the wall 22E of the second case 22. In this regard, the thermal-transfer printer 1A may allow the cover 23 to be easily connected with the second case 22. Similarly, the rear end of the first area T3, which defines the position of the first axis X21, is defined by the rearward wall 24D of the second case 24. The upper end of the first area T3 and the upper end of the second area T4 are defined by the upper wall 24E of the second case 24. In this regard, the thermal-transfer printer 1B may have the areas, in which the first axis X21 and the second axis X22 are located, to stay within the case 2B.

More Examples

Although examples of carrying out the invention have been described, those skilled in the art will appreciate that there are numerous variations and permutations of the thermal-transfer printer that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

The following paragraphs describe more examples derivable from any of the first, second, and third embodiments. In the following paragraphs, the examples are described representatively based on the first embodiment.

For example, in the thermal-transfer printer 1A described above, the area above the ink ribbon supporting member 3 may be exposed while the cover 23 is at the second position (open position). Therefore, the user is enabled to attach the cartridge case 4 to the ink ribbon supporting member 3 from the upper side. However, the side, from which the cartridge case 4 is attachable to the ink ribbon supporting member 3, may not necessarily be limited to the upper side, but the cartridge case 4 may be attachable to the ink ribbon supporting member 3 from any of the front side, the rear side, the left side, the right side, and the lower side of the ink ribbon supporting member 3. In the case where the cartridge case 4 is attachable to the ink ribbon supporting member 3 from the front side, the rear side, the left side, the right side, or the lower side of the ink ribbon supporting member 3, the ink ribbon supporting member 3 may be exposable from the front side, the rear side, the left side, the right side, or the lower side, respectively, while the cover 23 is at the second position (open position).

For another example, the thermal-transfer printer 1A may not necessarily be equipped with the first case 21 or the second case 22, as long as the thermal-transfer printer 1A is equipped with the ink ribbon supporting member 3, the cover 23, and the head holder 5; and the ink ribbon supporting member 3, the cover 23, and the head holder 5 are supported by a supporting member, e.g., a frame, other than the cases 21, 22.

For another example, the ink ribbon supporting member 3 in the thermal-transfer printer 1A may support the ribbon rolls R1, R2, directly. For example, the ink ribbon supporting member 3 may be equipped with a case, which may be substantially in the same form as the cartridge case 4. In other words, the cartridge case 4 may not necessarily be detachable from the ink ribbon supporting member 3.

For another example, the head holder 5 may be pivotably supported by the cover 23 directly without being supported by the linkages 233. In this configuration, the second axis X12 being the pivot axis for the head holder 5 may be located in a position closer to the cover 23.

For another example, when the cover 23 moves from the second position (open position) toward the first position (closed position), the conveyer roller 51C in the head holder 5 may not necessarily contact the ink ribbon roll R extended between the ribbon rolls R1, R2 from the upper side, but the thermal head 50 on the head holder 5 may contact the ink ribbon R directly.

For another example, the upper end of the first area T1, in which the first axis 11 is located, may be located between the upper wall 22E of the second case 22 and the upper-end position Sp13. The upper end of the first area T1 may be located at a position higher than the upper wall 22E of the second case 22. The rear end of the first area T1 may be located to be rearward with respect to the rear wall 22D of the second case 22. In other words, the first axis X11 may be located at a position higher than the case 2A. For another example, moreover, the upper end of the second area T2, in which the second axis X12 is located, may be located at a position higher than the upper wall 22E of the second case 22. In other words, the second axis X12 may be located at a position higher than the case 2A.

For another example, the plane S12, which defines the lower ends of the first area T1 and the second area T2, and the plane S13, which defines the upper ends of the first area T1 and the second area T2, may be defined based on a maximum radius Rm for the ribbon rolls R1, R2. More specifically, the plane S12 may be located at a position lower than the plane S11 for a distance of the maximum radius Rm, and the plane S13 may be located at a position higher than the plane S11 for the distance of the maximum radius Rm.

For another example, the direction of the pathway for the head holder 5 to contact the ink ribbon R while the cover 23, 28, or the head arm 9 moves from the second position to the first position, may not necessarily be limited to downward but may be a direction inclining frontward or rearward with respect to the vertical direction.

For another example, with regard to the first embodiment, the first axis X11 may be located in proximity to the plane S11 within the first area T1. The second axis X12 may be located within the frontward divided area T21 or within the rearward divided area T23, among the divided areas T21, T22, T23, which are equally divided into three in the front-rear direction between the first center C11 and the second center C12. The first axis X11 may be located at a midst position between the upper wall 22E of the second case 22 and the plane S11. With regard to the second embodiment, the first axis X21 may be located to coincide with the plane S21 within the first area T3. The second axis X22 may be located within the frontward divided area T41 or within the rearward divided area T43, among the divided areas T41, T42, T43, which are equally divided into three in the front-rear direction between the first center C21 and the second center C22. The first axis X21 may be located at a midst position between the upper wall 24E of the second case 24 and the plane S21.

The plane S11 containing the first center C11 and the second center S12, and the plane S21 containing the first center C21 and the second center C22, may not necessarily spread horizontally but may incline with respect to the horizontal direction. When the planes S11, S21 incline with respect to the horizontal direction, the first area T1 and the second area T2, and the first area T3 and the second area T4, which are defined by the positions of the first center C11 and the second center C12, and the first center C21 and the second center C22, respectively, may incline with respect to the horizontal direction as well.

For another example, as shown in FIG. 13, a plane S3 containing the first axis X11 and the second center C12 may be defined. In this arrangement, the second axis X12 may be located at a position coincident with the plane S3. Accordingly, the orientation of the tangent for the pathway circle at the intersection between the plane S3 and the pathway circle may be orthogonal to the plane S3. Thereby, the thermal-transfer printer 1A may restrain the head holder 5 from contacting the ribbon roll R1, which is located in proximity to the first axis X11, effectively. Therefore, the thermal-transfer printer 1A may restrain the head holder 5 from contacting the ribbon rolls R1, R2 effectively regardless of the diameters of the ribbon rolls R1, R2.

What is claimed is:

1. A thermal-transfer printer configured to print an image on a printing medium by heating an ink ribbon through a thermal head, comprising:

a medium storage configured to store the printing medium therein;

an ink ribbon supporting member, to which the ink ribbon connected to a first spool at one end and to a second spool at the other end is attachable, the ink ribbon supporting member being located to be at least partly higher than the medium storage;

a movable member configured to be pivotable, when the thermal-transfer printer is in a predetermined orientation with a bottom face facing downward and an upper face located at a position higher than the bottom face in a direction of gravity, about a first axis to move between a first position and a second position being higher than the first position, the first axis extending in a predetermined direction, the movable member being located to be at least partly higher than the ink ribbon supporting member when the thermal-transfer printer is in the predetermined orientation; and a head holder pivotably attached to the movable member to pivot about a second axis extending in the predetermined direction;

an arm member pivotably supported by the ink ribbon supporting member, the arm member being pivotable about a third axis extending in the predetermined direction at a position different from the first axis and the second axis, the arm member being configured to support the head holder when the movable member is at the second position by engaging with a part of the head holder and configured to be disengaged from the part of the head holder when the movable member is at the first position, wherein, in the ink ribbon supporting member, a center of the first spool and a center of the second spool extend in parallel with the predetermined direction;

the center of the first spool and the center of the second spool are spaced apart from each other by a predetermined distance in an orthogonal direction, the orthogonal direction being orthogonal to the predetermined direction; and the ink ribbon is attachable with the second spool being arranged at a position closer to a first side of the thermal-transfer printer than the first spool in the orthogonal direction, wherein one of the thermal head and the head holder is configured to contact the ink ribbon extended between the first spool and the second spool in response to the movable member moving from the second position toward the first position, and wherein when the thermal-transfer printer is in the predetermined orientation and the movable member is at the first position, the first axis is located in an area, which is:

closer to a second side of the thermal-transfer printer in the orthogonal direction than a first center being a position of the center of the first spool, the second side being opposite to the first side in the orthogonal direction; and higher than a lower-end position, the lower-end position being lower than the first center and a second center being a position of the center of the second spool, the lower-end position being apart from the first center and the second center for a half distance being the predetermined distance divided equally by two, and wherein, when the thermal-transfer printer is in the predetermined orientation and the movable member is at the first position, the second axis is located in an area, which is:

closer to the first side in the orthogonal direction than the first center;

closer to the second side in the orthogonal direction than the second center; and higher than the lower-end position.

2. The thermal-transfer printer according to claim 1, wherein, when the thermal-transfer printer is in the predetermined orientation, the first axis is located within the half distance above the first center and the second center.

3. The thermal-transfer printer according to claim 1, wherein the first axis is located in proximity to a plane containing the first center and the second center.

4. The thermal-transfer printer according to claim 1, wherein, under the condition where the movable member is at the first position, the second axis is located at a position coincident with a plane containing the first axis and the second center.

5. The thermal-transfer printer according to claim 1, wherein, when the thermal-transfer printer is in the predetermined orientation and under the condition where the movable member is at the first position, the second axis is located within the half distance above the first center and the second center.

6. The thermal-transfer printer according to claim 1, wherein, when the thermal-transfer printer is in the predetermined orientation and the movable member is at the first position, the second axis is located in a center one of three trisected areas, the trisected areas dividing an area between the first center and the second center in the orthogonal direction equally into three.

7. The thermal-transfer printer according to claim 1, wherein, when the thermal-transfer printer is in the predetermined orientation, in a state where the one of the thermal head and the head holder contacts the ink ribbon extended between the first spool and the second spool in response to the movable member moving from the second position toward the first position, a direction of the head holder extending from the second axis toward the thermal head is a downward direction.

8. The thermal-transfer printer according to claim 1, further comprising:

a case configured to store at least the printing medium and the ink ribbon therein, the case comprising:

a lower case having an opening at an upper side thereof when the thermal-transfer printer is in the predetermined orientation; and an upper case pivotably attached to the lower case to pivot about a fourth axis extending in the predetermined direction, the upper case being configured to move between a third position, in which the upper case covers at least a part of the opening of the lower case, and a fourth position, in which the upper case uncovers the opening of the lower case, wherein, when the thermal-transfer printer is in the predetermined orientation and the upper case is located at the third position, the first axis is located in an area, which is:

closer to the first side of the thermal-transfer printer in the orthogonal direction than an end of the upper case closer to the second side in the orthogonal direction; and lower than an upper end of the upper case, and wherein, when the thermal-transfer printer is in the predetermined orientation and the upper case is located at the third position, the second axis is located in an area, which is lower than the upper end of the upper case.

9. The thermal-transfer printer according to claim 8, wherein the first axis is located in proximity to the upper end of the upper case.

10. The thermal-transfer printer according to claim 1, wherein, when the thermal-transfer printer is in the predetermined orientation and the movable member is at the second position, the ink ribbon is attachable to the ink ribbon supporting member from an upper side.

11. The thermal-transfer printer according to claim 1, wherein a distance between a portion of the arm member engaging with the part of the head holder and the third axis when the movable member is located at the second position is shorter than a distance between the third axis and the second axis.

12. The thermal-transfer printer according to claim 1, wherein a distance between a portion of the arm member engaging with the part of the head holder and the movable member when the movable member is located at the second position is shorter than a distance between the portion of the arm member engaging with the part of the head holder and the movable member when the part of the head holder contacts the arm member while the movable member is in transition to pivot from the first position to the second position.

* * * * *